US006407504B1

(12) United States Patent
Niimi

(10) Patent No.: US 6,407,504 B1
(45) **Date of Patent: *Jun. 18, 2002**

(54) HIGH PRESSURE DISCHARGE LAMP HAVING COMPOSITE ELECTRODE

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/140,587

(22) Filed: Aug. 26, 1998

Related U.S. Application Data

(63) Continuation-in-part of application No. 08/998,311, filed on Dec. 24, 1997, now Pat. No. 6,169,366.

(51) Int. Cl.[7] ..... H01J 17/04; H01J 61/04

(52) U.S. Cl. ..... 313/623; 313/633; 313/625; 313/572

(58) Field of Search ..... 313/625, 572, 313/573, 634, 636, 623, 631, 632, 311; 220/21 R

(56) References Cited

U.S. PATENT DOCUMENTS

| | | | | |
|---|---|---|---|---|
| 4,749,905 A | * | 6/1988 | Mori et al. | 313/623 |
| 5,861,714 A | * | 1/1999 | Wei et al. | 313/625 |

FOREIGN PATENT DOCUMENTS

| | | |
|---|---|---|
| EP | 0 160 445 A | 11/1985 |
| EP | 0 271 877 A | 6/1988 |
| EP | 0 341 750 A | 11/1989 |
| EP | 0 609 477 A | 8/1994 |
| EP | 0 751 549 A | 1/1997 |
| EP | 0 807 957 A | 11/1997 |
| HU | 214 798 B | 5/1995 |
| JP | 2-132750 | 5/1990 |
| JP | 02 132750 | 5/1990 |
| JP | 07 211292 A | 8/1995 |
| JP | 7-211292 | 8/1995 |
| JP | 8-273616 | 10/1996 |
| JP | 08 273616 | 10/1996 |

* cited by examiner

*Primary Examiner*—Michael H. Day
*Assistant Examiner*—Joseph Williams
(74) *Attorney, Agent, or Firm*—Burr & Brown

(57) ABSTRACT

A vessel has a main body and a plugging members made of alumina. First composite electrode has a cylindrical current conductor having substantially same diameter as a diameter of the opening portion at one end of the vessel, and an electrode jointed by welded at a bottom of the current conductor exposed to inside of the vessel. The current conductor of the first composite electrodes has a cylindrical member made of alumina and a metallization layer made of molybdenum and alumina. A ceramic discharge tube is made in that the vessel and a first composite electrode have been subjected to a co-firing into an integrated body, with the first composite electrode inserted into the opening portion at one end of the vessel so that the electrode is exposed to the inner space with one end of the first composite electrode is exposed to outside of the vessel.

34 Claims, 25 Drawing Sheets

HIGH PRESSURE DISCHARGE LAMP HAVING COMPOSITE ELECTRODE

This application is a continuation-in-part application of the present application Ser. No. 08/998,311 filing date Dec. 24, 1997, now U.S. Pat. No. 6,169,366.

FIELD OF THE INVENTION

The present invention relates to a high pressure discharge lamp, such as a high pressure sodium light-emitting lamp, a metal halide lamp, and to a method of manufacturing such a high pressure discharge lamp. The present invention also relates to a composite electrode for a high pressure discharge lamp, and a method of manufacturing such a composite electrode.

BACKGROUND ART

Conventionally, such a high pressure discharge lamp comprises a vessel made of a non-conductive material (e.g. alumina) which forms an inner space filled with an ionizable light-emitting material and a starting gas, and which has opening portions at the ends thereof. The high pressure discharge lamp also comprises a composite electrode having a substantially cylindrical current conductor made of a conductive material (e.g. molybdenum) with a diameter which is substantially the same as that of the opening portion at one end of the vessel, and an electrode electrically connected to the current conductor. In this instance, a gap between the current conductor and the vessel is tightly sealed.

In this type of high pressure discharge lamp, there is a significant difference between the coefficient of thermal expansion of the conductive material forming the current conductor and that of the non-conductive material forming the vessel (for example, the coefficient of thermal expansion of alumina is $8\times10^{-6}$ $K^{-1}$, and that of molybdenum is $6\times10^{-6}$ $K^{-1}$). Owing to such a difference, when the high pressure discharge lamp is heated such as when the high pressure discharge lamp is in operation, there may be formed a gap between the current conductor on one hand and the vessel and/or the plug on the other hand. In this instance, as the molecular movement of the ionizable light-emitting material and the starting gas in the vessel becomes more active, these ionizable light-emitting material and starting gas may leak through the gap to outside of the vessel.

To avoid such a drawback, JP-A-2-132750 discloses a high pressure discharge lamp wherein, instead of forming the current conductor with only conductive material, the current conductor comprises a substantially cylindrical non-conductive material (e.g. alumina), which is same as that forming the vessel and coated by tungsten with a substantially uniform thickness over the surface of the non-conductive material. In this case, the composite electrode is composed such that a concave portion is provided at the bottom of the current conductor and an electrode is buried in the concave portion, or the electrode is connected to the current conductor with another member such as a cap. Also, the vessel and the composite electrode have been subjected to a co-firing into an integrated body, with the current conductor inserted into the opening portion at one end of the vessel so that the electrode is exposed to the inner space with one end of the composite electrode exposed to outside of the vessel. In this way, by composing most of the current conductor of a non-conductive material which is the same as the that forming the vessel, the adverse influence of the difference in the coefficient of thermal expansion between the conductive material (in this case, tungsten) and the non-conductive material is made substantially insignificant.

Also, JP-A-7-211292 discloses a high pressure discharge lamp wherein the current conductor comprises a substantially cylindrical non-conductive material, which is the same as that forming the vessel, and covered by a layer of mixture of platinum and alumina, a layer of platinum, and a layer of a mixture of platinum and alumina, with a substantially uniform thickness and one above the other over the surface of the non-conductive material. In this case, also, the composite electrode is composed such that a concave portion is provided at the bottom of this current conductor and an electrode is buried in the concave portion, or the electrode is connected to the current conductor with another member such as a cap. Therefore, the adverse influence of the difference in the coefficient of thermal expansion between the conductive material and the non-conductive material is made substantially insignificant.

Also, JP-A-8-273616 discloses a high pressure discharge lamp wherein the current conductor is formed with the substantially cylindrical non-conductive material, which is the same as that forming the vessel material, and covered by a halide-resistant metal such as niobium, tungsten, etc., with a substantially uniform thickness over the surface of the non-conductive material. In this case, the composite electrode is also composed such that a concave portion is provided at the bottom of this current conductor and an electrode is buried in the concave portion, or the electrode is connected to the current conductor with another member such as a cap. Therefore, the adverse influence of the difference in the coefficient of thermal expansion between the conductive material and the non-conductive material is made substantially insignificant.

However, in the high pressure discharge lamp disclosed in JP-A-2-132750, the composite electrode having the current conductor metallized with tungsten, whose melting point (3400° C.) is higher than that of alumina (2015° C.), is co-fired with the vessel into an integrated body. In this case, the melting point of tungsten in metallization is much different from that of alumina in metallization, so that the firing speed of tungsten is different from that of alumina. Also, the mutual wetting property of tungsten and aluminum is poor, and it is thus difficult to form a tightly metallized layer. Therefore, such a high pressure discharge lamp does not have a fully gas-tight property.

Further, in the high pressure discharge lamps disclosed in JP-A-7-211292 and JP-A-8-273616, the vessel and the composite electrode are not co-fired into an integrated body at least at one end of the vessel. Thus, a stronger junction cannot be formed between the non-conductive material of the vessel and metallized layer on the composite electrode, as compared to an arrangement wherein the vessel and the composite electrode are co-fired into an integrated body. Therefore, such a high pressure discharge lamp does not have a fully gas-tight property, either.

Moreover, in the composite electrodes for the high pressure discharge lamps disclosed in JP-A-2-132750, JP-A-7-21 1292 and JP-A-8-273616, it is preferred that the composite electrode can be easily manufactured and has a uniform thickness of the metallized layer over the surface of the current conductor.

On the other hand, in the conventional high pressure discharge lamp, when the gap between the current conductor and the vessel is tightly sealed, there is used a frit seal. In this case, the proximity of the opening portion at one end of the vessel is heated to a predetermined temperature (e.g. 1500°

C.). On such occasion, the other end of the vessel is cooled in order to prevent the molecular movement of the ionizable light-emitting material and starting gas from being active such that they are prevented from leakage through the frit seal of the vessel to outside of the vessel. However, in spite of such cooling, the inner part of the vessel is still heated to a substantial temperature (e.g. 300–400° C.) even for a limited period (e.g. 1–3 minutes). Thus, there still remains the possibility for the ionizable light-emitting material and starting gas to more or less leak through the frit seal of the vessel to outside of the vessel.

Moreover, in manufacturing the composite electrode by jointing the electrode to the current conductor, it is preferable to have a high bonding strength between the electrode and the current conductor, a high corrosion resistance, and a, high conductivity.

SUMMARY OF THE INVENTION

It is a first object of the present invention to provide a high pressure discharge lamp having a satisfactory gas-tight property while fully maintaining the required conductivity, as well as a method of manufacturing the same.

It is a second object of the present invention to provide the high pressure discharge lamp capable of preventing the ionizable light-emitting material and starting gas filled in the inner portion of the vessel from leaking to outside of the vessel at the time of tightly sealing, as well as a method of the manufacturing the same.

It is a third object of the present invention to provide the composite electrode for a high pressure discharge lamp, which is easy to manufacture and realize a uniform thickness of the metallized layer over the surface of the current conductor, as well as a method of the manufacturing the same.

It is a fourth object of the present invention to provide the high pressure discharge lamp having a high bonding strength between the electrode and the current conductor, a high corrosion resistance, and a high conductivity.

The high pressure discharge lamp according to the invention comprises a vessel made of a non-conductive material which forms an inner space filled with an ionizable light-emitting material and a starting gas, and has opening portions at both ends thereof; and a composite electrode having a substantially cylindrical current conductor with a diameter which is substantially the same as a diameter of the opening portion at one end of the vessel, and an electrode electrically connected to the current conductor;

said current conductor of the composite electrode being formed by a substantially cylindrical member coated with a mixture of a metal and a non-conductive material on at least a tubular surface thereof;

said metal of the mixture coated on said substantially cylindrical member containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner space with one end of the composite electrode is exposed to outside of the vessel.

According to the invention, the current conductor is formed by a substantially cylindrical member coated with a mixture of a metal and a non-conductive material on at least a tubular surface thereof, and the composite electrode comprising such a current conductor and the vessel have been subjected to a co-firing into an integrated body. By having been subjected to a co-firing into an integrated body in such a manner, the non-conductive material in the vessel and the substantially cylindrical member is diffused into the layer of the mixture formed on a surface of the substantially cylindrical member so that a strong joining structure is formed between the vessel and the substantially cylindrical member.

Here, in order to form such a strong joining structure, it is necessary for the metal of the mixture coated on at least a tubular surface thereof the substantially cylindrical member to contain a metal which has melting point comparatively close to those of the nearly cylindrical member and. the vessel, etc, and has enough halide resistance, and for its non-conductive material to contain a material which is the same as that forming the vessel and the substantially cylindrical member. To fulfill such requirements, according to the high pressure discharge lamp of the invention, the metal of the mixture coated on at least a tubular surface of the substantially cylindrical member contains not less than 50 vol. % of molybdenum which has halide resistance and lower melting point (2623° C.) than that of tungsten, and the non-conductive conductive material of the mixture coated on the substantially cylindrical member contains not less than 50 vol. % of a material which is the same as that forming the vessel.

Therefore, with the current conductor being formed by the substantially cylindrical member coated with the mixture of a metal and a non-conductive material on at least a tubular surface thereof, and the vessel and the composite electrode having been subjected to a co-firing into an integrated body to form a strong joining structure between the vessel and the substantially cylindrical member, the high pressure discharge lamp according to the invention has a fully gas tight property while maintaining full conductivity. Further, a substantially cylindrical member is understood to mean not only a cylindrical member itself but also a member in which a concave portion is provided at the bottom of the cylindrical member and a member in which the bottom of the cylindrical member is inclined to an axis thereof as described hereinafter.

Preferably, the content of said metal of the mixture coated on said substantially cylindrical member is 30 to 70 vol. %.

As the content of the metal of the mixture coated on at least a tubular surface of the substantially cylindrical member becomes high, the conductivity of the high pressure discharge lamp improves. On the other band, as the content of the non-conductive material of the mixture becomes high, the gas tight property of the high pressure discharge lamp improves. As the result of various experiments by the inventor, in order to maintain the gas tight property while maintaining full conductivity, it is found that the preferable content of the metal of the mixture is 30 to 70 vol. %.

More preferably, said metal of the mixture coated on said substantially cylindrical member is made of molybdenum, said non-conductive material of the mixture is made of a material which is same as that forming said vessel.

In order that the vessel and the composite electrode have subjected to a co-firing into an integrated body to form a strong joining structure between the vessel and the nearly cylindrical shaped member of the current conductor, it is preferable that the content of molybdenum in the metal of the mixture coated on at least a tubular surface of the substantially cylindrical member is as high as possible, and the content of the material which is the same as that forming the vessel in the non-conductive material of the mixture is as high as possible. Therefore, it is the most suitable for the mixture to compose of molybdenum and the material which is the same as that forming the vessel.

Further, molybdenum is understood to mean not only pure molybdenum but also that containing a few impurities, and the material which is the same as that forming the vessel is understood to mean not only completely the same as that forming the vessel but also that containing few impurities.

Another high pressure discharge lamp according to the invention comprises a vessel made of a non-conductive material which forms an inner space filled with an ionizable light-emitting material and a starting gas, and has opening portions at both ends thereof; and a composite electrode having a substantially cylindrical current conductor with a diameter which is smaller than a diameter of the opening portion at one end of the vessel, and an electrode electrically connected to the current conductor;

said current conductor of the composite electrode being formed by a substantially cylindrical member coated with a mixture of a metal and a non-conductive material; said metal of the mixture coated on said substantially cylindrical member containing not less than 50 vol. % of molybdenum, and said non-conductive material of the mixture containing not less than 50 vol. % of a material which is the same as that forming said vessel on at least a tubular surface thereof;

said current conductor and said vessel being so arranged relative to each other as to leave a gap therebetween, with the composite electrode inserted into the opening portion at one end of the vessel so that the electrode is exposed to the inner space and one end of the composite electrode is exposed to outside of the vessel, said gap being tightly sealed with a metallic layer or a layer made of a mixture of a metal and a material which is the same as that forming said vessel.

According to another high pressure discharge lamp of the invention, the substantially cylindrical current conductor with a diameter which is smaller than a diameter of the opening portion at one end of the vessel is formed by the substantially cylindrical member coated with mixture of the metal and the non-conductive material on at least a tubular surface thereof and the current conductor and the vessel are so arranged relative to each other as to leave a gap therebetween, with the composite electrode inserted into the opening portion at one end of the vessel so that the electrode is exposed to the inner space and one end of the composite electrode is exposed to outside of the vessel, the gap being tightly sealed with a metallic layer or a layer made of a mixture of a metal and a material which is the same as that forming said vessel. By tight sealing with such a layer in such a manner, only proximity of the opening portion of one end of the vessel is heated in a moment. Unlike the prior high pressure discharge lamp in which tight sealing is effected with a frit seal, it is not heated over a certain temperature (eg. 300–400° C.) for a certain time (e.g. 1–3 minutes) so that the movement of the ionizable light-emitting material and the starting as does not become active and leak the ionizable light-emitting material and the starting gas to outside of the vessel.

Another high pressure discharge lamp according to the invention comprises a vessel made of a non-conductive material which forms an inner space filled with an ionizable light-emitting material and a starting gas, and has opening portions at both ends thereof; a first composite electrode having a substantially cylindrical current conductor with a diameter which is substantially the same as a diameter of the opening portion at one end of the vessel, and an electrode electrically connected to the current conductor; and a second composite electrode having a substantially cylindrical current conductor with a diameter which is smaller than a diameter of the opening portion at the other end of the vessel, and an electrode electrically connected to the current conductor;

each of said current conductors of the first and second composite electrodes being formed by a substantially cylindrical member coated with a mixture of a metal and a non-conductive material on at least a tubular surface thereof, said metal of the mixture coated on said substantially cylindrical member containing not less than 50 vol. % of molybdenum, and said non-conductive material of the mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being gas tightly sealed with a metallic layer or a layer made of a mixture of a metal and a material which is the same as that forming said vessel.

According to another high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-filing into an integrated body, the high pressure discharge lamp according to the invention have a fully gas tight property while maintaining full conductivity.

In this case, although the gap may be tight sealed with such a layer, it may be tight sealed with the frit seal as usual.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is substantially same as a diameter of the opening portion at one end of the vessel, and an electrode jointed by welding or metallizing at a bottom or a side of the current conductor exposed to inside of the vessel;

said current conductor of the composite electrode being formed by a cylindrical member coated with a mixture of a metal and a non-conductive material at on at least a tubular surface;

said metal of the mixture coated on said cylindrical member containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner space and one end of the composite electrode is exposed to outside of the vessel.

According to another high pressure discharge lamp of the invention, with the current conductor of the composite electrode being formed by a substantially cylindrical member coated with a mixture of a metal and a non-conductive material on at least a tubular surface thereof, and the composite electrode and the vessel having been subjected to a co-firing into an integrated body, the high pressure discharge lamp according to the invention has a fully gas tight property while maintaining full conductivity.

In this case, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Also, by jointing the electrode by welding or metallizing at a side of current conductor, a bonding area between the current conductor and the electrode or an area contacting the mixture to the current conductor and the electrode increases, so that the bonding strength between the current conductor and the electrode can further improve.

Preferably, at least one end of the current conductor exposed to inside of the vessel is rounded, the electrode is jointed by metallizing at the rounded end.

By providing such a rounded end, an area contacting the mixture to the current conductor is wider than the case where the rounded end is not provided, so that the bonding strength between the current conductor and the electrode can improve much more. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a non-conducting material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conducting material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is smaller than a diameter of the opening portion at one end of the vessel, and an electrode jointed by welding or metallizing at a bottom or a side of the current conductor exposed to inside of the vessel;

said current conductor of the composite electrode being formed by a cylindrical member coated with a mixture of a metal and a non-conductive material on at least a tubular surface thereof;

said metal of the mixture coated on said substantially cylindrical member containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space and one end of the composite electrode is exposed to outside of the vessel, said gap being tightly sealed with a metallic layer or a layer made of a mixture of a metal and a material which is the same as that forming said vessel.

According to another high pressure discharge lamp of the invention, as only the proximity of the opening portion of one end of the vessel is heated in a moment, the ionizable light-emitting material and the starting gas may not leak to outside of the vessel.

Also, as the electrode is jointed by welding or metallizing at a bottom or a made of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor exposed to inside of the vessel is rounded, and the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a nor-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conducting material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another high pressure discharge lamp according to the invention comprises a vessel made of a non conductive material which forms an inner space filled with an ionizable light-emitting material and a starting gas, and has opening portions at both ends thereof; a first composite electrode having a cylindrical current conductor with a diameter which is substantially the same as a diameter of the opening portion at one end of the vessel, and an electrode jointed by welding or metallizing at a bottom of the current conductor exposed to inside of the vessel; and a second composite electrode having a cylindrical current conductor with a diameter which is smaller than a diameter of the opening portion at the other end of the vessel, and an electrode jointed by welding or metallizing at a bottom or a side of the current conductor exposed to inside of the vessel;

each of said current conductors of the first and second composite electrodes being formed by a cylindrical member coated with a mixture of a metal and a non-conductive material on at least a tubular surface thereof;

said metal of the mixture coated on said substantially cylindrical member containing not less than 50 vol. % of molybdenum, and said non-conductive material of the mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being tightly sealed with a metallic layer or a layer made of a mixture of a metal and a material which is the same as that forming said vessel.

According to another high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while maintaining full conductivity.

In this case, instead of gas tight sealing the gap between the current conductor and the vessel at the other end of the vessel by the layer of the mixture of the metal and the non-conductive material gas tight sealing may be effected with a frit seal such as used in usual.

Also, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor exposed to inside of the vessel is rounded, and the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conducting material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof; and a composite electrode having a substantially cylindrical current conductor with a diameter which is substantially same as a diameter of the opening portion at one end of the vessel and a bottom inclined to an axis thereof exposed to inside of the vessel, and an electrode jointed by welding or metallizing at the bottom exposed to inside of the vessel;

said current conductor of the composite electrodes being formed by a substantially cylindrical member coated with a mixture of a metal and a non-conductive material on at least a tubular surface thereof;

said metal of the mixture coaled on said substantially cylindrical member containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner space with one end of the composite electrode is exposed to outside of the vessel.

According to another high pressure discharge lamp of the invention, with the current conductor of the composite electrode being formed by a substantially cylindrical member coated with a mixture of a metal and a non-conductive material on at least one side, and the composite electrode and the vessel having been subjected to a co-firing into an integrated body, the high pressure discharge lamp according to the invention has a fully gas tight property and full conductivity.

In this case, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor exposed to inside of the vessel is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a non-conductive material which has a higher melting point and/or a higher corrosion resistance than a metal or a mixture of a metal and a non-conductive material which joints the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portion at both ends thereof; a composite electrode having a substantially cylindrical current conductor with a diameter which is smaller than a diameter of the opening portion at one end of the vessel and a bottom inclined to an axis thereof exposed to inside of the vessel, and an electrode jointed by welding or metallizing at the inclined bottom of the current conductor exposed to inside of the vessel;

said current conductor of the composite electrode being formed by a substantially cylindrical member coated with a mixture of a metal and a non-conductive material on at least a tubular surface thereof;

said metal of the mixture coated on said substantially cylindrical member containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space with one end of the composite electrode is exposed to outside of the vessel, said gap being gas tightly sealed with a metallic layer or a layer made of a mixture of a metal and a material which is the same as that forming said vessel.

According to another high pressure discharge lamp of the invention, as only proximity of the opening portion of one end of the vessel is heated in a moment, the ionizable light-emitting material and the starting gas may not leak to outside of the vessel.

Also, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor exposed to inside of the vessel is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a non-conductive material having a higher melting point and/or a higher corrosion resistance than a metal or a mixture of a metal and a non-conducting material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conducting material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portion at both ends thereof; a first composite electrode having a substantially cylindrical current conductor with a diameter which is substantially the same as a diameter of the opening portion at one end of the vessel and a bottom inclined to an axis thereof exposed to inside of the vessel, and an electrode jointed by welding or metallizing at the bottom of the current conductor exposed to inside of the vessel; and a second composite electrode having a substantially cylindrical current conductor with a diameter which is smaller than a diameter of the opening portion at the other end of the vessel and a bottom inclined to an axis thereof exposed to inside of the vessel, and an electrode jointed by welding or metallizing at the bottom of the current conductor exposed to inside of the vessel;

each of said current conductors of the first and second composite electrodes being formed by a substantially cylindrical member coated with a mixture of a metal and a non-conductive material on at least a tubular surface thereof;

said metal of the mixture coated on said substantially cylindrical member containing not less than 50 vol. % of molybdenum, and said non-conductive material of the mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being gas tightly sealed with a metallic layer or a layer made of a mixture of a metal and a material which is same as that forming said vessel.

According to another high pressure discharge lamp of the invention, with the current conductor of the first composite electrode being formed by a substantially cylindrical member coated with a mixture of a metal and a non-conductive material on at least a tubular surface thereof and the first composite electrode and the vessel having been subjected to a co-firing into an integrated body, the high pressure discharge lamp according to the invention has a fully gas tight property while maintaining full conductivity.

In this case, instead of tight sealing the gap between the current conductor and the vessel at the other end of the vessel by the layer of the mixture of the metal and the non-conductive metal, gas tight sealing may be effected with a frit seal such as used in usual.

Also, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor exposed to inside of the vessel is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a bottom or a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor exposed to inside of the vessel is rounded, the electrode is jointed by metallizing at the rounded end, a metal or a mixture of a metal and a non-conductive material having a higher melting point and/or a higher corrosion resistance than a metal or a mixture of a metal and a non-conducting material jointing the electrode and the current conductor is coated on the joint portion of the electrode and the current conductor and the proximity thereof.

By providing such a rounded end, an area contacting the mixture to the current conductor is wider tan the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is substantially the same as a diameter of the opening portion at one end of the vessel, and an electrode jointed by welding or metallizing at a side of the current conductor exposed to inside of the vessel;

said current conductor of the composite electrode being formed by a cylindrical member coated with a mixture of a metal and a non-conductive material on at least a tubular surface thereof, an axis of the electrode substantially corresponding to that of an electrode to be opposite to the electrode, said metal of the mixture coated on said cylindrical member containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner space with one end of the composite electrode is exposed to outside of the vessel.

According to another high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while maintaining full conductivity.

In this case as the electrode is jointed by welding or metallizing at a side of the current conductor, an area contacting the mixture to the current conductor is wider than the case where the electrode is jointed at a bottom of the current conductor whose bottom is perpendicular to an axis thereof, so that the bonding strength between the electrode and the current conductor improves.

Further, to promote ignition of the high pressure discharge lamp, it is preferable for an axis of the electrode to substantially correspond to that of an electrode to be opposite to the electrode. According to the invention, as an axis of the electrode substantially corresponds to that of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof; and a composite electrode having a cylindrical current conductor with a diameter which is smaller than a diameter of the opening portion at one end of the vessel, and an electrode jointed by welding or metallizing at a side of the current conductor exposed to inside of the vessel;

said current conductor of the composite electrode being formed by a cylindrical member coated with a mixture of a metal and a non-conductive material on at least a tubular surface thereof, an axis of the electrode substantially corresponding to that of an electrode to be opposite to the electrode, said metal of the mixture coated on said cylindrical member containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space and one end of the composite electrode is exposed to outside of the vessel, said gap being gas tightly sealed with a metallic layer or a layer made of a mixture of a metal and a material which is the same as that forming said vessel.

According to another high pressure discharge lamp of the invention, as only the proximity of the opening portion of one end of the vessel is heated in a moment, the ionizable light-emitting and the starting gas may not leak to outside of the vessel.

Also, as an axis of the electrode substantially corresponds to an axis of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof; a first composite electrode having substantially cylindrical current conductor with a diameter which is substantially same as a diameter of the opening portion at one end of the vessel, and an electrode jointed by welding or metallizing at a side of the current conductor exposed to inside of the vessel; and a second composite electrode having a substantially cylindrical current conductor with a diameter which is smaller than a diameter of the opening portion at the other end of the vessel, and an electrode jointed by welding or metallizing at a side of the current conductor exposed to inside of the vessel;

each of said first and second current conductor of the composite electrode being formed by a substantially cylindrical member coated with a mixture of a metal and a non-conductive material on at least a tubular surface thereof, an axis of the electrode of the first composite electrode substantially corresponding to that of the second composite electrode;

said metal of the mixture coated on said substantially cylindrical member containing not less than 50 vol. % of molybdenum, and said non-conductive material of the mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space and one end of the second composite electrode is exposed to outside of the vessel, said gap being gas tightly sealed with a metallic layer or a layer made of a mixture of a metal and a material which is the same as that forming said vessel.

According to another high pressure discharge lamp of the invention, with the current conductor of the first composite electrode being formed by a substantially cylindrical member coated with a mixture of a metal and a non-conductive material on at least a tubular surface thereof, and first composite electrode and the vessel having been subjected to a co-firing into an integrated body, the high pressure discharge lamp according to the invention has a fully gas tight property while maintaining full conductivity.

In this case, instead of gas light sealing the gap between the current conductor and the vessel at the other end of the vessel by the layer of the mixture of the metal and the non-conductive material, gas tight sealing may be effected with a frit seal such as used in usual.

Also, as an axis of the electrode substantially corresponds to that of an electrode to be opposite to the electrode, it is possible to promote ignition of the high pressure discharge lamp.

Preferably, the electrode is jointed by welding or metallizing as a side of the current conductor.eposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof and a metal or a mixture of a metal and a non-conductive material coated at the proximity of at least one opening portion; an electrode jointed by metallizing at the proximity of the opening portion so as to expose to the inner space; and a plug made of a non-conductive material with a diameter which is substantially same as a diameter of the at least one opening portion;

said metal of the mixture coated on the opening portion containing not less than 50 vol. % of molybdenum, and said non-conductive material of the mixture containing not less than 50 vol. % of a material which is the same as that forming said vessel;

said vessel and said plug having been subjected to a co-firing into an integrated body, with the plug inserted into the at least one opening portion.

By jointing the electrode at the proximity of the opening portion, an area contacting the mixture to the electrode and the proximity of the opening portion is enough, so that bonding strength to the electrode becomes high.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another high pressure discharge lamp according to the invention comprises a vessel made of a non-conductive material which forms an inner space filled with an ionizable light-emitting material and a starting gas, and has opening portions at both ends thereof and a metal or a mixture of a metal and a non-conductive material coated at the proximity of at least one opening portion; an electrode jointed by metallizing at the proximity of the opening portion so as to expose to the inner space; and a plug made of a non-conductive material with a diameter which is smaller than a diameter of the at least one opening portion;

said metal of the mixture coated on the opening portion containing not less than 50 vol. % of molybdenum, and said non-conductive material of the mixture containing not less than 50 vol. % of a material which is the same as that forming said vessel;

said plug and said vessel being so arranged relative to each other as to leave a gap therebetween, with the plug inserted into the opening portion coated on the mixture, said gap being tightly sealed with metallic layer or a layer made of a mixture of a metal and material which is the same as that forming said vessel.

By jointing the electrode at the proximity of the opening portion, an area contacting the mixture to the electrode and the proximity of the opening portion is enough, so that bonding strength to the electrode becomes high.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor, the bonding strength between the current conductor and the electrode and/or the corrosion resistance further improves.

The composite electrode for a high pressure discharge lamp according to the invention has a current conductor which forms a cylindrical members made of non-conductive material coated with a mixture of a metal and a non-conductive material on at least a tubular surface thereof; and an electrode jointed by welding or metallizing at a bottom or a side of the current conductor, said metal of the mixture coated on said cylindrical member containing not less than 50 vol. % of molybdenum, and said non-conductive material of the mixture containing not less than 50 vol. % of a material which is the same as that forming said vessel.

As the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents from a stress concentration at the proximity of the end. Moreover, by using the metal or the mixture of the metal and the non-conducting material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another composite electrode for a high pressure discharge lamp according to the invention has a current conductor which forms a substantially cylindrical member coated with a mixture of a metal and a non-conductive material on at least a tubular surface thereof, and has a bottom inclined to an axis thereof; and an electrode jointed by welding or metallizing at the inclined bottom;

said metal of the mixture coated on said cylindrical member containing not less than 50 vol. % of molybdenum, and said non-conductive material of the mixture containing not less than 50 vol. % of a material which is the same as that forming said vessel.

As the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents from a stress concentration at the proximity of the end. Moreover, by using the metal or the mixture of the metal and the non-conducting material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another composite electrode for a high pressure discharge lamp according to the invention has a current conductor which forms a cylindrical member coated with a mixture of a metal and a non-conductive material on at least a tubular surface thereof; and an electrode jointed by welding or metallizing at a side of the current conductor; an axis of the electrode substantially corresponding to that of an electrode to be opposite to the electrode, said metal of the mixture coated on said cylindrical member containing not less than 50 vol. % of molybdenum, and said non-conductive material of the mixture containing not less than 50 vol. % of a material which is the same as that forming said vessel.

As an axis of the electrode substantially corresponds to that of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor, the bonding strength between the current conductor and the electrode and/or the corrosion resistance further improves.

The method of manufacturing a high pressure discharge lamp according to the invention comprises the steps of; forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material on at least a tubular surface thereof and an electrode electrically connected to the current conductor;

said metal of the mixture coating on the substantial cylindrical member containing not less than 50 vol. % of molybdenum, said non-conductive material of the mixture containing not less than 50 vol. % of a material which is the same as that forming said vessel and said substantially cylindrical current conductor has substantially same diameter as a diameter of the opening portion at one end of the vessel;

inserting said composite electrode into the opening portion at one end of the vessel such that the electrode is exposed to the inner space and one end of the composite electrode is exposed to outside of the vessel, and co-firing said vessel and said composite electrode into an integrated body.

According to the method of manufacturing a high pressure discharge lamp of the invention, with the current conductor of the first composite electrode being formed by a substantially cylindrical member coated with a mixture of a metal and a non-conductive material on at least a tubular surface thereof, and the composite electrode and the vessel having been subjected to a co-firing into an integrated body, the high pressure discharge lamp according to the invention have a full gas tight property while maintaining full conductivity.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material on at least a tubular surface thereof and an electrode electrically connected to the current conductor;

said metal of the mixture coating on the substantial cylindrical member containing not less than 50 vol. % of molybdenum, said non-conductive material of the mixture containing not less than 50 vol. % of a material which is the same as that forming said vessel, and said substantially cylindrical current conductor has smaller diameter than a diameter of the opening portion at one end of the vessel;

inserting said composite electrode into the opening portion at one end of the vessel such that the electrode is exposed to the inner space and one end of the composite electrode is exposed to outside of the vessel, and said current conductor and said vessel being so arranged relative to each other as to leave a gap therebetween, said gap being gas tightly sealed with a metallic layer or a layer made of a mixture of a metal and a material which is the same as that forming said vessel.

According to another method of manufacturing a high pressure discharge lamp of the invention, as only the proximity of the opening portion of one end of the vessel is heated in a moment, the ionizable light-emitting material and the starting gas may not leak to outside of the vessel.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming first and second composite electrodes which have a current conductor formed by a substantially cylindrical member coated with a mixture of a metal on at least a tubular surface thereof and a non-conductive material and an electrode electrically connected to the current conductor, respectively;

said metal of the mixture coating on the substantial cylindrical member containing not less than 50 vol. % of molybdenum, and said non-conductive material of the mixture containing not less than 50 vol. % of a material which is the same as that forming said vessel, said substantially cylindrical current conductor of the first composite electrode has substantially same diameter as a diameter of the opening portion at one end of the vessel and said substantially cylindrical current conductor of the second composite electrode has smaller diameter than a diameter of the opening portion at the other end of the vessel;

inserting said first composite electrode into the opening portion at one end of the vessel such that the electrode is exposed to the inner space and one end of the first composite electrode is exposed to outside of the vessel, and co-firing said vessel and said first composite electrode into an integrated body; and inserting said second composite electrode into the opening portion at the other end of the vessel such that the electrode is exposed to the inner space and one end of the second composite electrode is exposed to outside of the vessel, and said current conductor and said vessel being so arranged relative to each other as to leave a gap therebetween, said gap being gas tightly sealed with a metallic layer or a layer made of a mixture of a metal and a material which is same as that forming said vessel.

According to another method of manufacturing a high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while and full conductivity.

In this case, the gap may be gas tight sealed with a frit seal as usual.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a cylindrical member coated with a mixture of a metal and a non-conductive material on at least a tubular surface thereof and an electrode jointed by welded or metallizing at a bottom or a side of the current conductor;

said metal of the mixture coating on the cylindrical member containing not less than 50 vol. % of molybdenum, said non-conductive material of the mixture containing not less than 50 vol. % of a material which is the same as that forming said vessel, and said cylindrical current conductor has substantially same diameter as a diameter of the opening portion at one end of the vessel;

inserting said composite electrode into the opening portion at one end of the vessel such that the electrode is exposed to the inner space and one end of the composite electrode is exposed to outside of the vessel, and co-firing said vessel and said composite electrode into an integrated body.

According to another method of manufacturing a high pressure discharge lamp of the invention, with the current conductor of the composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while maintaining full conductivity.

In this case, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conducting material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a cylindrical member coated with a mixture of a metal and a non-conductive material on at least a tubular surface thereof and an electrode jointed by welded or metallizing at a bottom or a side of the current conductor;

said metal of the mixture coating on the cylindrical member containing not less than 50 vol. % of molybdenum, said non-conductive material of the mixture containing not less than 50 vol. % of a material which is the same as that forming said vessel, and said cylindrical current conductor has smaller diameter than a diameter of the opening portion at one end of the vessel;

inserting said composite electrode into the opening portion at one end of the vessel such that the electrode is exposed to the inner space and one end of the composite electrode is exposed to outside of be vessel, and said current conductor and said vessel being so arranged relative to each other as to leave a gap therebetween, said gap being gas tightly sealed with a metallic layer or a layer made of a mixture of a metal and a material which is the same as that forming said vessel.

According to another method of manufacturing a high pressure discharge lamp of the invention, as only the proximity of the opening portion of one end of the vessel is heated in a moment, the ionizable light-emitting material and the starting gas may not leak to outside of the vessel.

Also, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming first and second composite electrodes which have a current conductor formed by a cylindrical member coated with a mixture of a metal and a non-conductive material on at least a tubular surface thereof and an electrode jointed by welded or metallizing at a bottom or a side of the current conductor, respectively;

said metal of the mixture coating on the cylindrical member containing not less than 50 vol. % of molybdenum, and said non-conductive material of the mixture containing not less than 50 vol. % of a material which is the same as that forming said vessel, said current conductor of the first composite electrode has substantially the same diameter as a diameter of the opening portion at one end of the vessel, and said current conductor of the second composite electrode has smaller diameter than a diameter of the opening portion at the other end of the vessel;

inserting said first composite electrode into the opening portion at one end of the vessel such that the electrode is exposed to the inner space and one end of the first composite electrode is exposed to outside of the vessel, and co-firing said vessel and said first composite electrode into an integral body; and inserting said second composite electrode into the opening portion at the other end of the vessel such that the electrode is exposed to the inner space and one end of the second composite electrode is exposed to outside of the vessel, and said current conductor and said vessel being so arranged relative to each other as to leave a gap therebetween, said gap being tightly sealed with a metallic layer or a layer made of a mixture of a metal and a material which is the same as that forming said vessel.

According to another high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while maintaining full conductivity.

In this case, instead of tight sealing the gap between the current conductor and the vessel at the other end of the vessel by the layer of the mixture of the metal and the non-conductive material, gas tight sealing may be effected with a frit seal such as used in usual.

Also, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material on at least a tubular surface thereof and having at least one bottom inclined to an axis thereof, and an electrode jointed by welding or metallizing at the inclined bottom;

said metal of the mixture coating on the substantially cylindrical member containing not less than 50 vol. % of molybdenum, said non-conductive material of the mixture containing not less than 50 vol. % of a material which is the same as that forming said vessel, and said current conductor has substantially the same diameter as a diameter of the opening portion at one end of the vessel;

inserting said composite electrode into the opening portion at one end of the vessel such that the electrode is exposed to the inner space and one end of the composite electrode is exposed to outside of the vessel, and co-firing said vessel and said composite electrode into an integral body.

According to another method of manufacturing a high pressure discharge lamp of the invention, with the current conductor of the composite electrode being formed by a substantially cylindrical member coated with a mixture of a metal and a non-conductive material on at least a tubular surface thereof, and the composite electrode and the vessel having been subjected to co-firing into an integrated body, the high pressure discharge lamp according to the invention has a fully gas tight property while maintaining full conductivity.

Further, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further increase. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a substantially cylindrical member coated with a mixture of a metal and a non-conductive material on at least a tubular surface thereof and having at least one bottom inclined to an axis thereof, and an electrode jointed by welding or metallizing at the inclined bottom;

said metal of the mixture coating on the substantially cylindrical member containing not less than 50 vol. % of molybdenum, said non-conductive material of the mixture containing not less than 50 vol. % of a material which is the same as that forming said vessel, and said current conductor has smaller diameter than a diameter of the opening portion at one end of the vessel;

inserting said composite electrode into the opening portion at one end of the vessel such that the electrode is exposed to the inner space and one end of the composite electrode is exposed to outside of the vessel, and said current conductor and said vessel being so arranged relative to each other as to leave a gap therebetween, said gap being gas tightly sealed with a metallic layer or a layer made of a mixture of a metal and a material which is the same as that forming said vessel.

According to another method of manufacturing a high pressure discharge lamp of the invention, as only proximity of the opening portion of one end of the vessel is heated in a moment, the ionizable light-emitting and the starting gas may not leak to outside of the vessel.

Further, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming first and second composite electrodes which have a current conductor formed by a substantially cylindrical member coated with a mixture of a metal and a non-conductive material on at least a tubular surface thereof and having at least one bottom inclined to an axis thereof, and an electrode jointed by welding or metallizing at the inclined bottom, respectively;

said metal of the mixture coating on the substantially cylindrical member containing not less than 50 vol. % of molybdenum, and said non-conductive material of the mixture containing not less than 50 vol. % of a material which is the same as that forming said vessel said current conductor of the first composite electrode has substantially the same diameter as a diameter of the opening portion at one end of the vessel, and said current conductor of the second composite electrode has smaller diameter than a diameter of the opening portion at the other end of the vessel;

inserting said first composite electrode into the opening portion at one end of the vessel such that the electrode is exposed to the inner space and one end of the first composite electrode is exposed to outside of the vessel, and co-firing said vessel and said composite electrode into an integral body; and inserting said second composite electrode into the opening portion at the other end of the vessel such that the electrode is exposed to the inner space and one end of the second composite electrode is exposed to outside of the vessel, and said current conductor and said vessel being so arranged relative to each other as to leave a gap therebetween, said gap being gas tightly sealed with a metallic layer or a layer made of a mixture of a metal and a material which is the same as that forming the vessel.

According to another method of manufacturing a high pressure discharge lamp of the invention, with the current conductor of the first composite electrode being formed by a substantially cylindrical member coated with a mixture of a metal and a non-conductive material on at least a tubular surface thereof, and the first composite electrode and the vessel having been subjected to a co-firing into an integrated body, the high pressure discharge lamp according to the invention has a fully gas tight property while maintaining full conductivity.

In this case, the gap may be sealed with a frit seal such as used in usual.

Also, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the ends of the inner space; and forming a composite electrode which has a current conductor formed by a cylindrical member coated with a mixture of a metal and a non-conductive material on at least a tubular surface thereof and an electrode jointed by welding or metallizing at a side of the current conductor;

said metal of the mixture coating on the cylindrical member containing not less than 50 vol. % of molybdenum, said non-conductive material of the mixture containing not less than 50 vol. % of a material which is the same as that forming said vessel, said cylindrical current conductor has substantially same diameter as a diameter of the opening portion at one end of the vessel, and an axis of the electrode substantially corresponding to that of an electrode to be opposite to the electrode;

inserting said composite electrode into the opening portion at one end of the vessel such that the electrode is exposed to the inner space and one end of the composite electrode is exposed to outside of the vessel, and co-firing said vessel and said composite electrode into an integral body.

According to another method of manufacturing a high pressure discharge lamp of the invention, with the current conductor of the composite electrode being formed by a cylindrical member coated with a mixture of a metal and a non-conductive material on at least a tubular surface thereof, and the composite electrode and the vessel having been subjected to a co-firing into an integral body, the high pressure discharge lamp according to the invention has a fully gas tight property while maintaining full conductivity.

Further, as the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Moreover, as an axis of the electrode substantially corresponds to that of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non conductive material formed with an inner space filled with an ionizable light-emitting material and a sting gas, and with opening portions at the ends of the inner space; and forming a composite electrode which has a current conductor formed by a cylindrical member coated with a mixture of a metal and a non-conductive material on at least a tubular surface thereof and an electrode jointed by welding or metallizing at a side of the current conductor;

said metal of the mixture coating on the cylindrical member containing not less than 50 vol. % of molybdenum, said non-conductive material of the mixture containing not less than 50 vol. % of a material which is the same as that forming said vessel, said cylindrical current conductor has smaller diameter than a diameter of the opening portion at one end of the vessel, and an axis of the electrode substantially corresponding to that of an electrode to be opposite to the electrode;

inserting said composite electrode into the opening portion at one end of the vessel such that the electrode is exposed to the inner space and one end of the composite electrode is exposed to outside of the vessel, and said current conductor and said vessel being so arranged relative to each other as to leave a gap therebetween, said gap being tightly sealed with a metallic layer or a layer made of a mixture of a metal and a material which is the same as that forming said vessel.

According to another method of manufacturing a high pressure discharge lamp of the invention, as only proximity of the opening portion of one end of the vessel is heated in a moment, the ionizable light-emitting and the starting gas may not leak to outside of the vessel.

Further, As the electrode is jointed by welding or metallizing at the inclined bottom, an area contacting the mixture to the current conductor is wider than the case where the electrode is jointed at a bottom of the current conductor whose bottom is perpendicular to an axis thereof, so that the bonding strength between the electrode and the current conductor improves.

Moreover, as an axis of the electrode substantially corresponds to that of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, and with opening portions at the end of the inner space; and forming first and second composite electrodes which have a current conductor formed by a cylindrical member coated with a mixture of a metal and a non-conductive material on at least a tubular surface thereof and an electrode jointed by welding or metallizing at a side of the current conductor, respectively;

said metal of the mixture coating on the cylindrical member containing not less than 50 vol. % of molybdenum, and said non-conductive material of the mixture containing not less than 50 vol. % of a material which is the same as that forming said vessel, said cylindrical current conductor of the first composite electrode has substantially same diameter as a diameter of the opening portion at one end of the vessel, said current conductor of the second composite electrode has smaller diameter than a diameter of the opening portion at the other end of the vessel, and an axis of the electrode of the first composite electrode substantially corresponding to that of the second composite electrode;

inserting said first composite electrode into the opening portion at one end of the vessel such that the electrode is exposed to the inner space and one end of the first composite electrode is exposed to outside of the vessel, and co-firing said vessel and said composite electrode into an integral body; and inserting said second composite electrode into the opening portion at the other end of the vessel such that the electrode is exposed to the inner space and one end of the second composite is exposed to outside of the vessel, and said current conductor and said vessel being so arranged relative to each other as to leave a gap therebetween, said gap being gas tightly sealed with a metallic layer or a layer made of a mixture of a metal and a material which is the same as that forming said vessel.

According to another high pressure discharge lamp of the invention, with the current conductor of the first composite electrode being formed by a cylindrical member coated with a mixture of a metal and a non-conductive material on at least a tubular surface thereof, and the first composite electrode and the vessel having been subjected to a co-firing into an integral body, the high pressure discharge lamp according to the invention has a fully gas tight property while maintaining full conductivity.

In this case, the gap may be sealed with a frit seal such as commonly used.

Further, as the electrode is jointed by welding or metallizing at the inclined bottom, an area contacting the mixture to the current conductor is wider th the case where the electrode is jointed at a bottom of the current conductor whose bottom is perpendicular to an axis thereof, so that the bonding strength between the electrode and the current conductor improves.

Moreover, as an axis of the electrode substantially corresponds to that of an electrode to be opposite to the electrode, it is possible to promote ignition of the high pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conducting material which joints the electrode and the current conductor in such a way, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, with opening portions at the ends of the inner space and a mixture of a metal and a non-conductive material coating on the proximity of at least one opening portion; forming an electrode; and forming a plug having a substantially same diameter as a diameter of the at least one opening portion;

said metal of the mixture coating on the proximity of the opening portion containing not less than 50 vol. % of molybdenum, said non-conductive material of the mixture containing not less than 50 vol. % of a material which is the same as that forming said vessel;

jointing said electrode by metallizing at the proximity of the opening portion, inserting said plug into the at least one opening portion such that the electrode is exposed to the inner space, and co-firing said vessel and said plug into an integral body.

By jointing the electrode at the proximity of the opening portion, an area contacting the mixture to the electrode and the proximity of the opening portion is enough, so that bonding strength to the electrode becomes high.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the nonconductive material which joints the electrode and the current conductor, the bonding strength between the current conductor and the electrode and/or the corrosion resistance further improves.

Another method of manufacturing a high pressure discharge lamp according to the invention comprises the steps of: forming a vessel made of a non-conductive material formed with an inner space filled with an ionizable light-emitting material and a starting gas, with opening portions at the ends of the inner space and a mixture of a metal and a non-conductive material coating on the proximity of at least one opening portion; forming an electrode; and forming a plug having a smaller diameter than a diameter of the at least one opening portion;

said metal of the mixture coating on the proximity of the opening portion containing not less than 50 vol. % of molybdenum, said non-conductive material of the mixture containing not less than 50 vol. % of a material which is the same as that forming said vessel;

jointing said electrode by metallizing at the proximity of the opening portion, inserting said plug into the at least one opening portion such that the electrode is exposed to the inner space, and said current conductor and said vessel being so arranged relative to each other as to leave a gap therebetween, said gap being tightly sealed with a metallic layer or a layer made of a mixture of a metal and a material which is the same as that forming said vessel.

By jointing the electrode at the proximity of the opening portion, an area contacting the mixture to the electrode and the proximity of the opening portion is enough, so that bonding strength to the electrode becomes high.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

The method of manufacturing a composite electrode for a high pressure discharge lamp according to the invention comprises the steps of: forming a current conductor made of a cylindrical member coated with a mixture of a metal and a non-conductive material on at least a tubular surface thereof, and an electrode welded or metallized jointed at a bottom or a side of the current conductor, said metal of the mixture coating on the cylindrical member containing not less than 50 vol. % of molybdenum, and said non-conductive material of the mixture containing not less than 50 vol. % of a material which is the same as that forming said vessel.

In this case, as the electrode is jointed by welding or metallizing at a bottom or a side of the current conductor which is formed by a cylindrical member coated with a mixture of a metal and a non-conductive material on at least a tubular surface thereof, it is possible to coat the mixture of the metal and the non-conductive material over a surface of the current conductor with more uniform thickness than the case where the electrode is buried on the concave portion at the bottom of this current conductor, and it is possible to compose the composite electrode simpler than the case where another member such as a cap is provided.

Preferably, at least one end of the current conductor is rounded, the electrode is jointed by metallizing at the rounded end.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metallizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a composite electrode for a high pressure discharge lamp according to the invention comprises the steps of: forming a current conductor made of a substantially cylindrical member coated with a mixture of a metal and a non-conductive material on at least a tubular surface thereof, with a bottom inclined to an axis thereof; and jointing an electrode by welding or metallizing at the inclined bottom;

said metal of the mixture coating on the substantially cylindrical member containing not less than 50 vol. % of molybdenum, and non-conductive material of the mixture containing not less than 50 vol. % of a material which is the same as that forming said vessel.

As the electrode is jointed by welding or metallizing at the inclined bottom, a bonding strength between the cement conductor and the electrode is higher than the case the electrode is jointed at a bottom perpendicular to an axis thereof.

Preferably, at least one end o the current conductor is rounded, the electrode is jointed by metallizing at the rounded end.

By providing such a rounded end, an area contacting the mixture to the current conductor is wider than the case there the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Moreover, such a rounded end prevents a stress concentration at the proximity of the end.

More preferably, the electrode is jointed by welding or metallizing at a side of the current conductor, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

More preferably, at least one end of the current conductor is rounded, the electrode is jointed by metalizing at the rounded end, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By providing such a rounded end, an area contacting the mixture to the current conductor is wider than the case where the rounded end is not provided, so that the bonding strength between the current conductor and the electrode can further improve. Also, as an area which contacts the mixture using the joint of the current conductor and the electrode to the mixture coated on the cylindrical member increases, the conductivity of the composite electrode becomes higher. Further, such a rounded end prevents a stress concentration at the proximity of the end. Moreover, by using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Another method of manufacturing a composite electrode for high pressure discharge lamp according to the invention comprises the steps of: forming a current conductor made of a cylindrical member coated with a mixture of a metal and a non-conductive material on at least a tubular surface thereof; and jointing an electrode by welding or metallizing at a side of the current conductor so that an axis of the electrode substantially matches with that of an electrode to be opposite to the electrode;

said metal of the mixture coating on the substantially cylindrical member containing not less than 50 vol. % of molybdenum, and non-conductive material of the mixture containing not less than 50 vol. % of a material which is the same as that forming said vessel.

Also, as an axis of the electrode substantially corresponds to that of an electrode to be opposite to the electrode, it is possible to promote ignition of the high a pressure discharge lamp.

Preferably, the electrode is jointed by welding or metallizing at a side of the current conductor exposed to inside of the vessel, a metal or a mixture of a metal and a non-conductive material having a higher melting point and/or a higher corrosion resistance than a metal or a mixture of a metal and a non-conductive material jointing the electrode and the current conductor is coated on the joint portion of the electrode and the current conductor and the proximity thereof.

By using the metal or the mixture of the metal and the non-conductive material which has a higher melting point and/or a higher corrosion resistance than the metal or the mixture of the metal and the non-conductive material which joints the electrode and the current conductor in such a way, the bonding strength between the current conductor and the electrode and/or the corrosion resistance further improves.

Further, when manufacturing the electrode or firing an arc tube, an external lead, etc (Mo, Ni, etc) is attached to the side of metallized coating of the composite electrode and the vessel and the composite electrode are co-fired into an integrated body.

DESCRIPTION OF THE PREFERRED EMBODIMENTS

Figure 1:
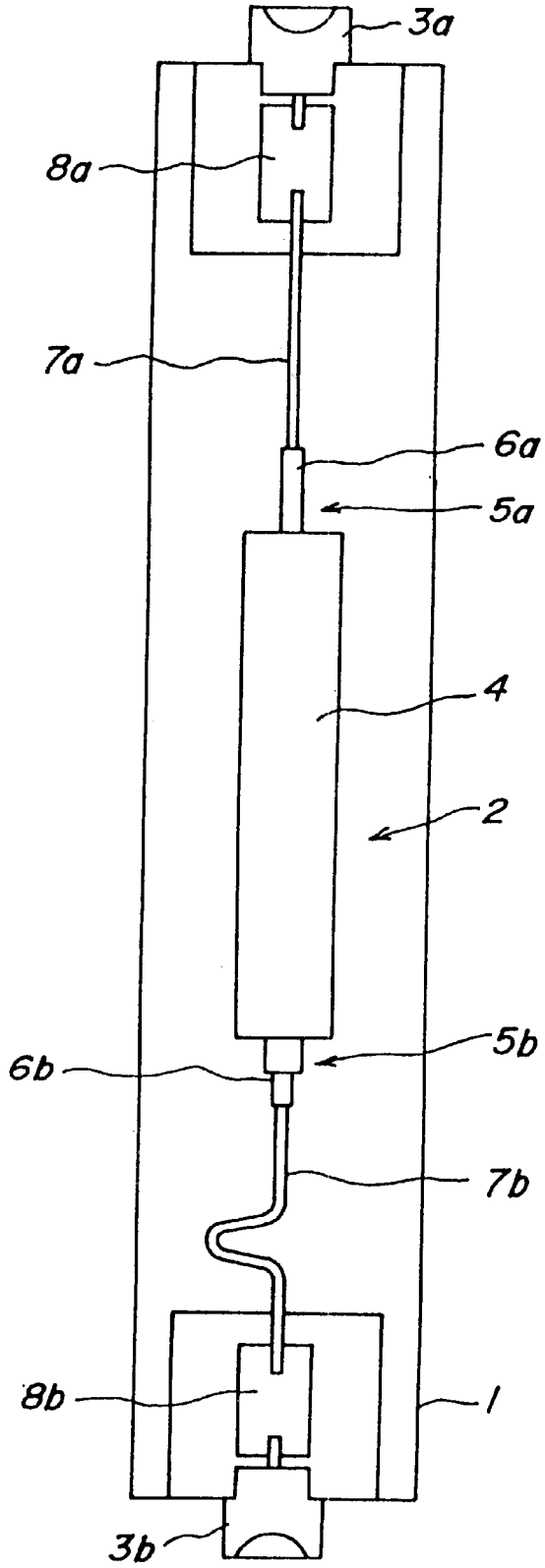
FIG. 1 is a view showing first embodiment of the invention.

FIG. 1 is a view showing a first embodiment of the invention. A ceramic tube 2 is accommodated within an outer tube 1 made of a quartz glass or a hard glass, and the center axis of the outer tube 1 is aligned with that of the ceramic tube 2.

Both ends of the outer tube 1 are gas-tightly sealed with caps 3*a,* 3*b,* respectively. The ceramic tube 2 comprises a tubular vessel 4 made of a alumina, and first and second composite electrodes 6*a,* 6*b* inserted into opening portions of ends portions 5*a,* 5*b* of the tubular vessel 4, respectively. The ceramic discharge lamp is held by the outer tube 2 via two lead wires 7*a,* 7*b,* and the lead wires 7*a,* 7*b* are connected to the caps 3*a,* 3*b* via foil 8*a,* 8*b,* respectively.

Figure 2:
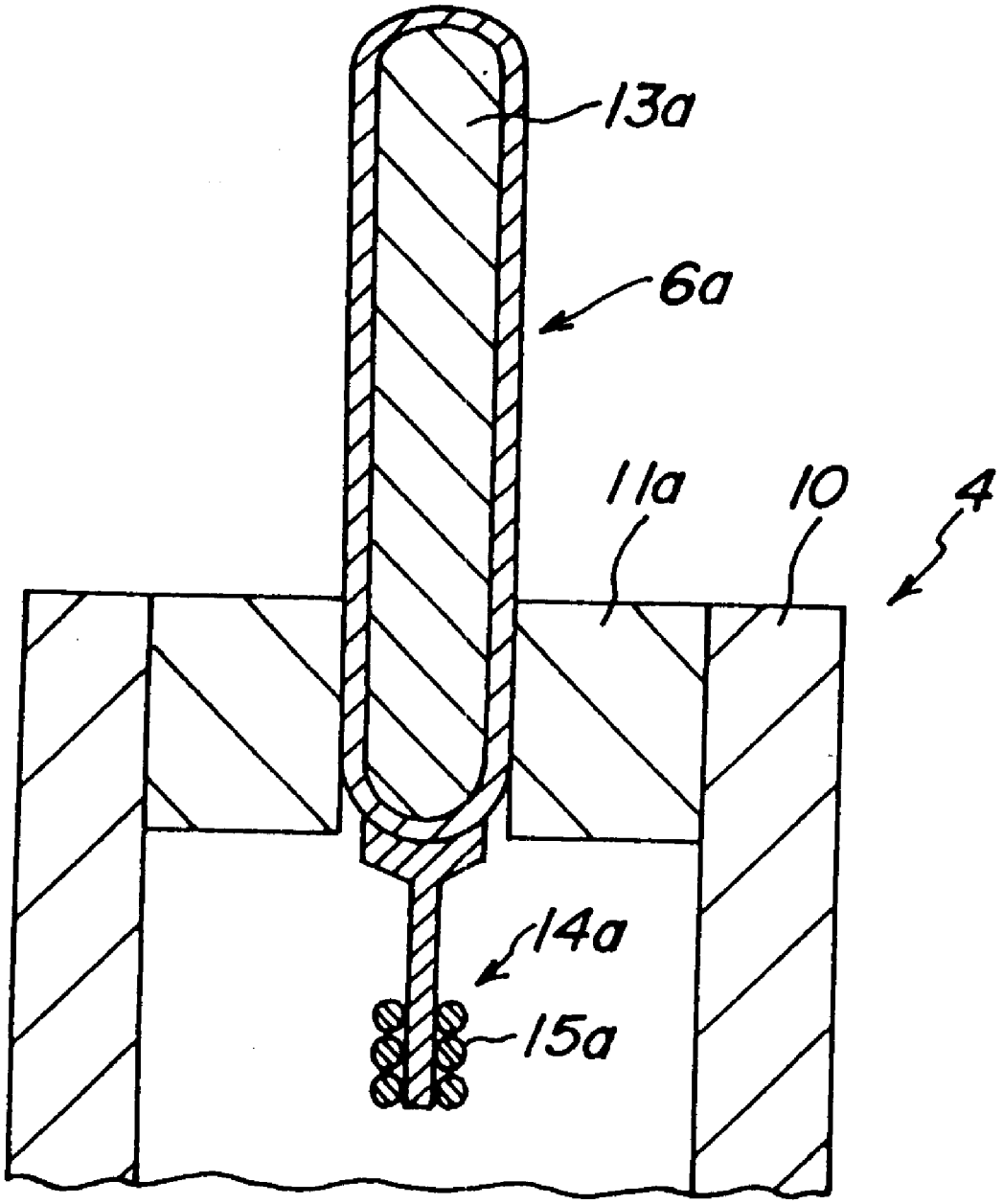
FIG. 2 is a sectional view for showing, in an enlarged scale, surrounding area around an end portion 5*a* of a ceramic discharge tube 2 of FIG. 1.

FIG. 2A is a top view for showing the end portion 5*a* of the ceramic discharge tube 2 in FIG. 1, and FIG. 2B is is a sectional view for showing, in an enlarged scale, surrounding the area around an end portion 5*a* of a ceramic discharge tube 2 in FIG. 1. As shown in FIGS. 2A and 2B, the vessel 4 has a main body 10 and a plugging member made of an alumina. The first composite electrode 6*a* has a cylindrical current conductor 13*a* with a diameter which is substantially the same as a diameter of the opening portion of the plugging member 11*a,* and a electrode 14*a* jointed by welding at a bottom of the current conductor 13*a* exposed to inside of the vessel 4. In this case, the electrode 14*a* has a coil 15*a.*

Figure 3:
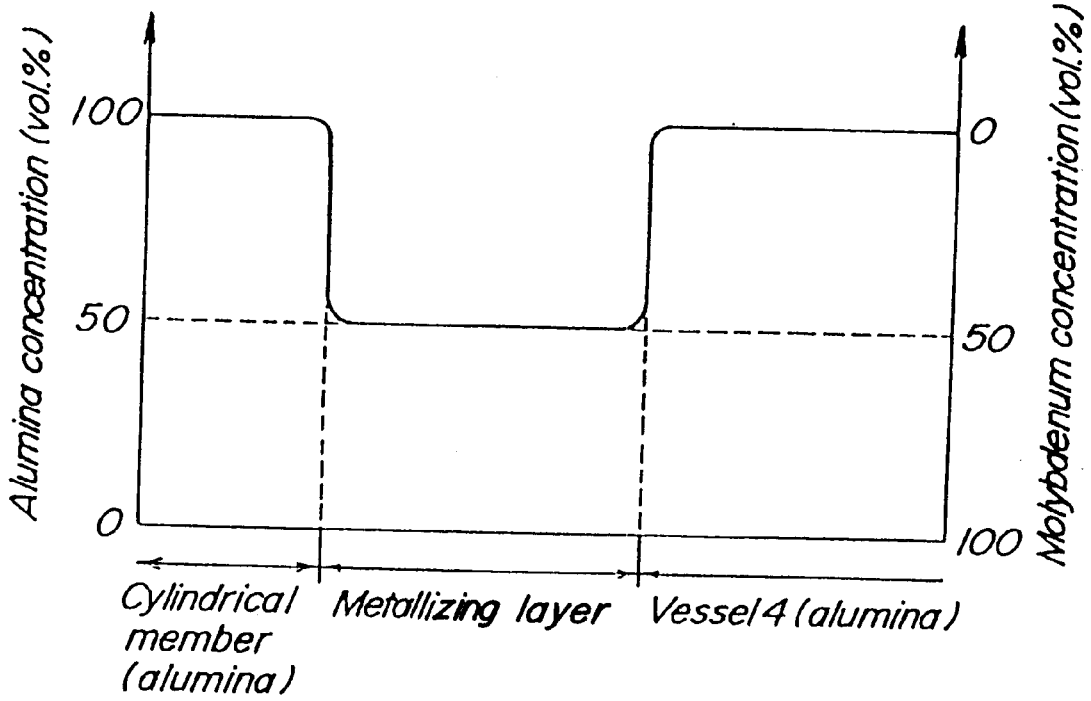
FIG. 3 is a diagram representing the transition of alumina and molybdemun concentrations in the cylindrical shaped member, the metallized layer and the vessel 4.

The first composite electrode 6*a* has a cylindrical member, and a metallizing layer composed of a mixture of a molybdenum and a alumina. A diagram representing the transition of alumina and molybdenum concentrations in the cylindrical member, the metallized layer and the vessel 4 is shown in FIG. 3.

The ceramic discharge tube (FIG. 1) is composed such that the vessel 4 and the first composite electrode 6*a* have been subjected to a co-firing into an integrated body, with the first composite electrode 6*a* inserted into the opening portion at one end of the vessel 4 so that the electrode 14 is exposed to the inner space with one end of the first composite electrode 6*a* is exposed to outside of the vessel 4.

Figure 4A:
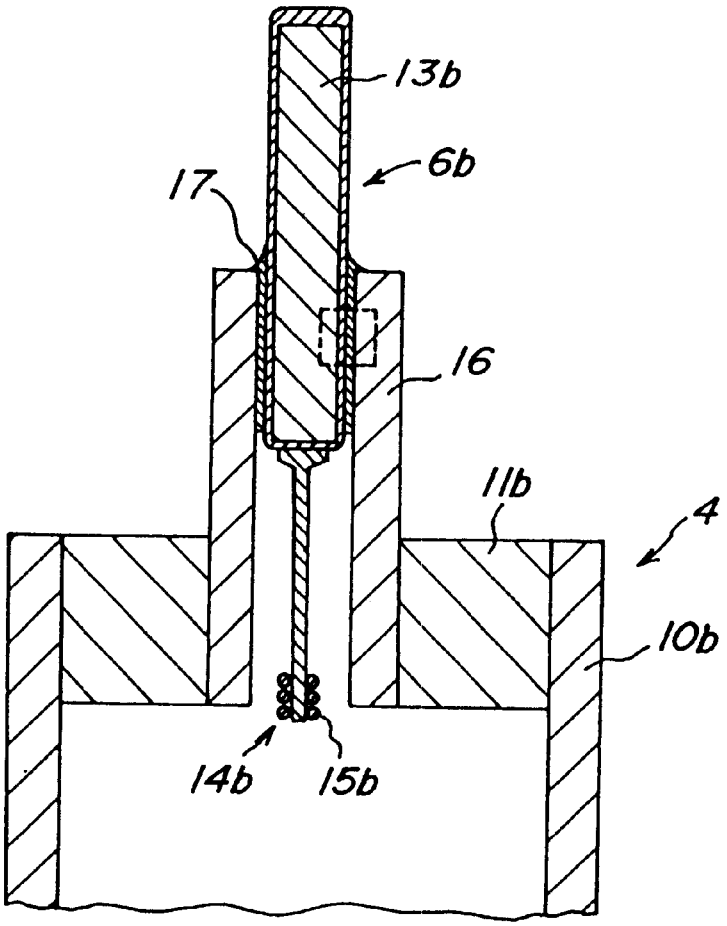
FIG. 4A is a sectional view for showing, in an enlarged scale, surrounding area around an end portion 5*a* of a ceramic discharge tube 2 of FIG. 1.
Figure 4B:
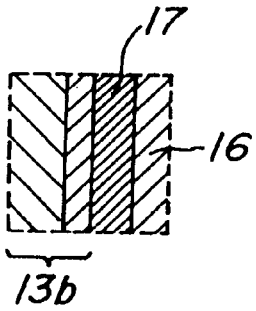
FIG. 4B is a partial enlarged view of the sectional view in FIG. 4A.

FIG. 4B is a sectional view for showing, in an enlarged scale, surrounding area around an end portion 5*b* of a ceramic discharge tube 2 in FIG. 1, and FIG. 4B is a partial enlarged view of the sectional view in FIG. 4A.

In FIGS. 4A and 4B, the vessel has a plugging member 11*b* made of the alumina and a capillary 16. The second composite electrode 6*b* has a cylindrical current conductor 13*b* with a diameter which is smaller than a diameter of the opening portion of the plugging member 11*b,* and a electrode 14*b* jointed by welding at a bottom of the current conductor 13*b* exposed to inside of the vessel 4. In this case, also, the electrode 14*b* has a coil 15*b.* Further, a gap between the second composite electrode 6*b* and the capillary 16 is tightly sealed with a frit seal 17.

Figure 5:
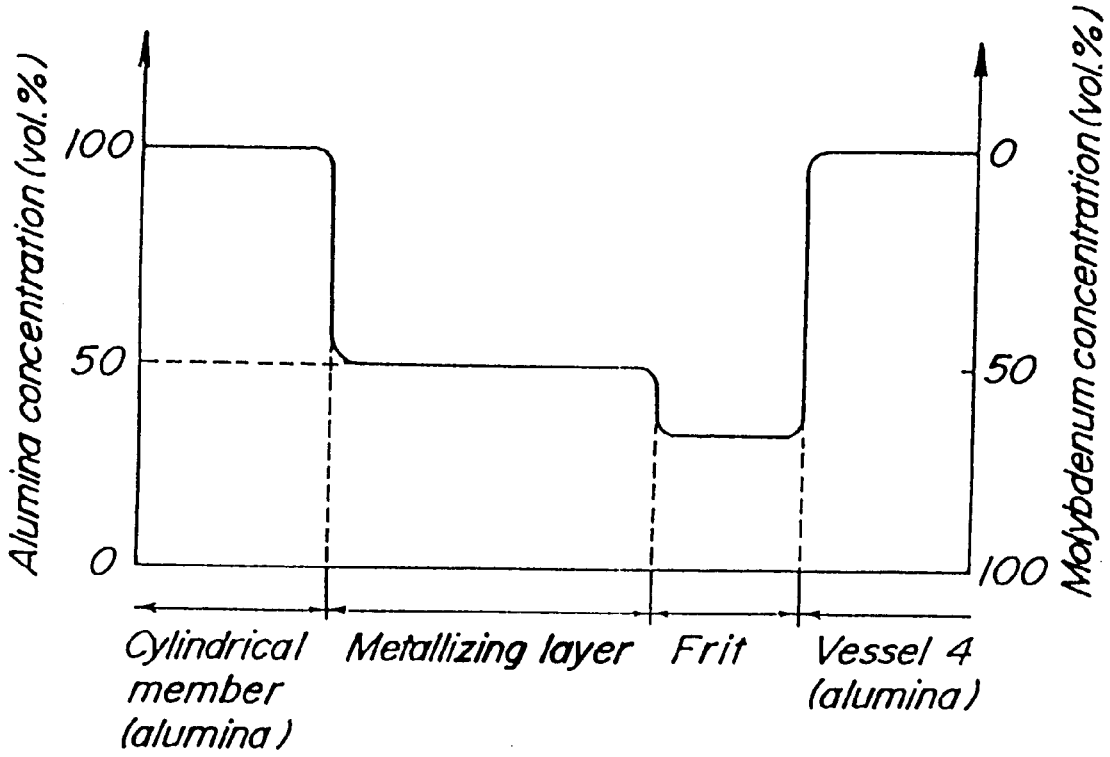
FIG. 5 is a diagram representing the transition of alumina and molybdemun concentrations in the cylindrical shaped member, the metabolized layer and the vessel 4.

The current conductor 13*b* of the second composite electrode 6*b* has a cylindrical member, and a metallizing layer composed of a mixture of a molybdenum and alumina. A diagram representing the transition of alumina and molybdenum concentrations in the cylindrical member, the metallized layer and the vessel 4 is shown in FIG. 5.

According to the embodiment of the invention, with the current conductor 13*a* of the first composite electrode 6*a* being formed by a substantially cylindrical member made of a material which is the same as that forming the vessel 4 (alumina) coated with the mixture of the molybdenum and alumina, and the first composite electrode 6*a* and the vessel 4 having been subjected to a co-firing into an integrated body, the high pressure discharge lamp has a fully gas tight property while maintaining full conductivity.

In this case, as the fully gas tight property is held at the end 6*a,* there is no drawback even if a temperature inside of the vessel 4 becomes high when the end portion 6*b* is gas tightly sealed.

Moreover, as the electrodes 15*a,* 15*b* are jointed by welding at the bottom of the current conductors 13*a,* 13*b* which is formed by a cylindrical member coated with the mixture of the molybdenum and alumina, respectively, it is possible to coat the mixture of the metal and alumina over a surface of the current conductor with more uniform thickness than the case where the electrode is buried in a concave portion at the bottom of the current conductor, and it is possible to compose the composite electrode simpler than the case where another member such as a cap is provided.

Figure 6A:
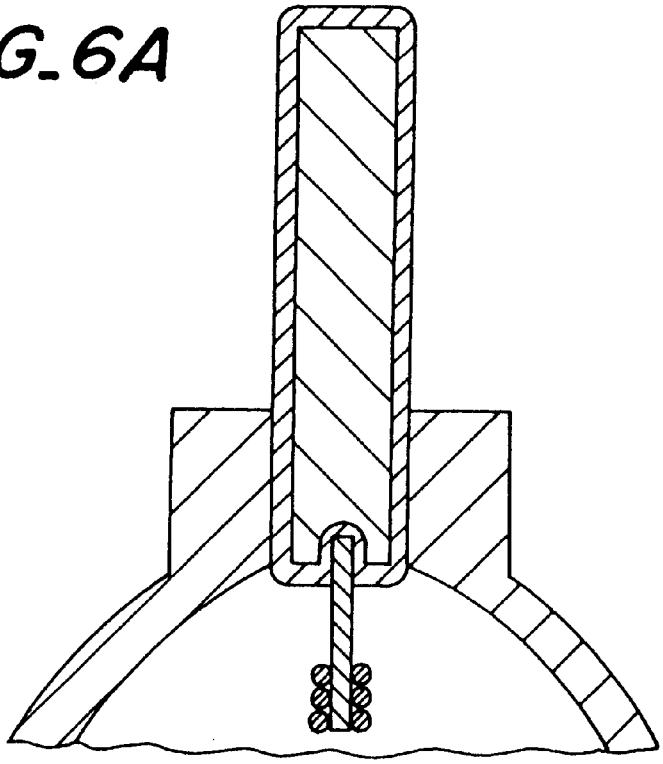
FIGS. 6A and 6B are views showing second embodiment of the invention.
Figure 6B:
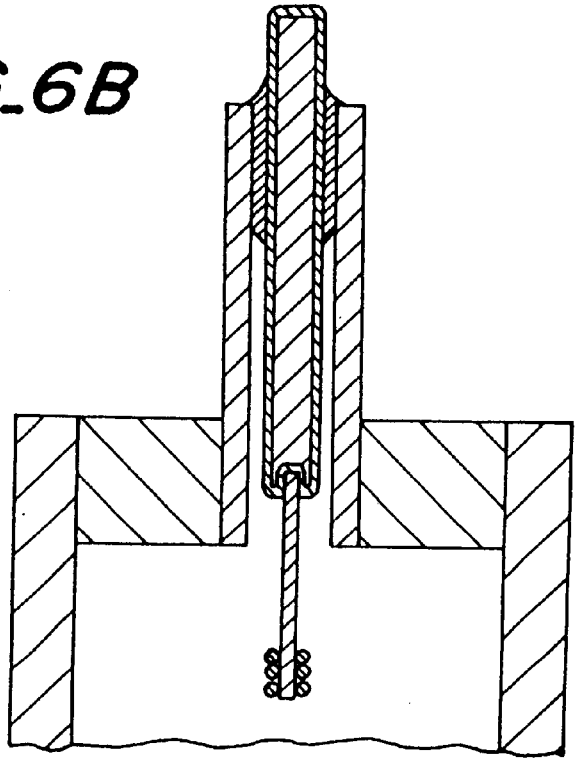

FIG. 6B is a sectional view for showing, in an enlarged scale, surrounding area around an end portion of a ceramic discharge tube in accordance with the first embodiment of the invention and FIG. 6B is a partial enlarged view of the sectional view thereof.

As shown in FIG. 6A, a barrel-shaped vessel can be used as the vessel, and a composite electrode which has a electrode buried in a concave portion at the bottom of a current conductor can be used as the first composite electrode. Also, as shown in FIG. 6B, a composite electrode which has a electrode buried in a concave portion at the bottom of a current conductor can be used as the second composite electrode. Further, in this case, as described after, a gap between the opening of the capillary and the current conductor is gas tightly sealed with the molybdenum or the mixture of the molybdenum and the alumina.

Figure 7:
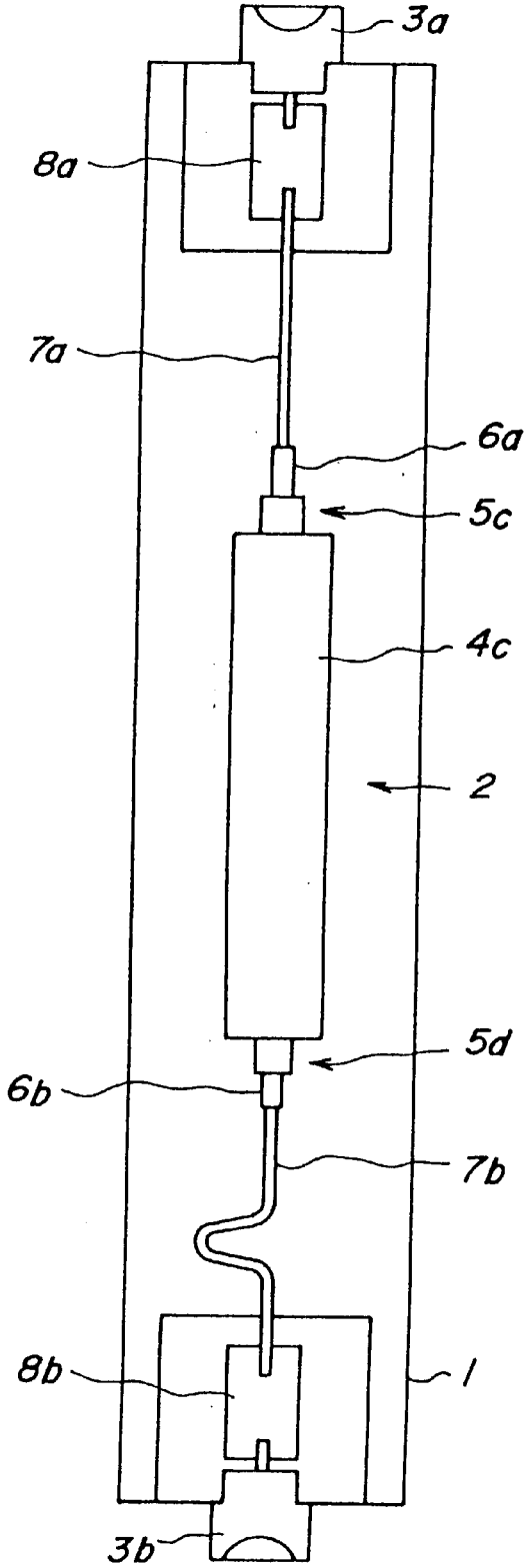
FIG. 7 is a view for describing the gas-tight sealing at one end of a ceramic discharge tube for a high pressure discharge lamp.
Figure 8:
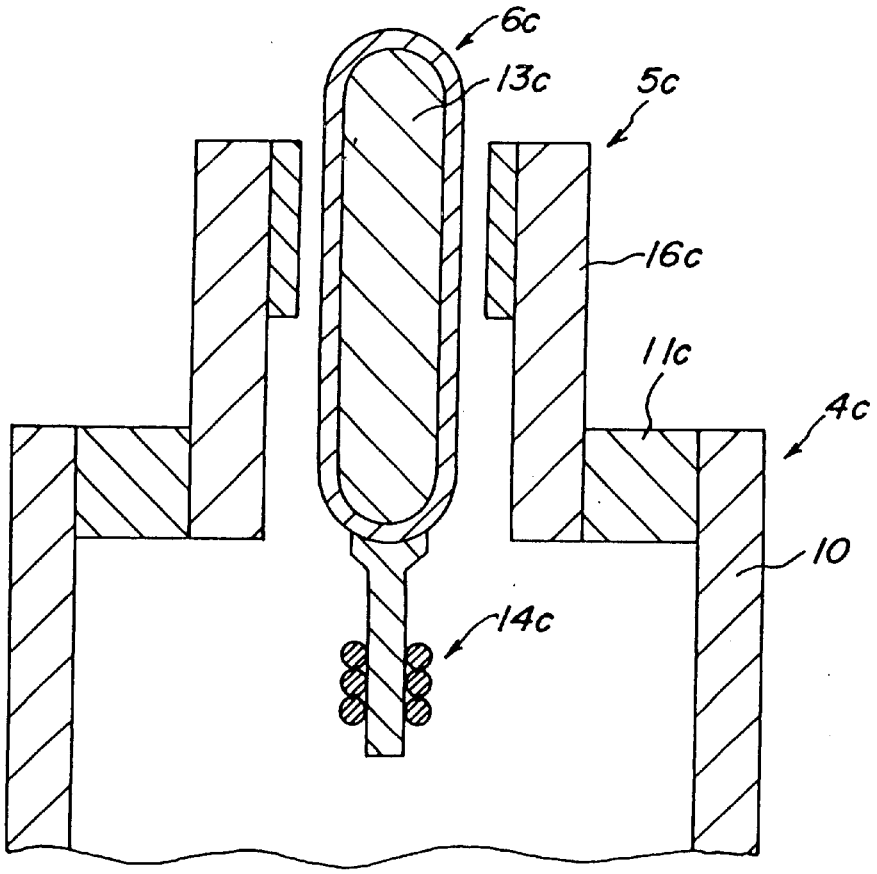
FIG. 8 is a view for describing the gas-tight sealing at one end of a ceramic discharge tube for a high pressure discharge lamp.

FIG. 7 is a view for showing a second embodiment of the high pressure discharge lamp in accordance with the invention, and FIG. 8 is a view for describing the gas-tight sealing at one end of a ceramic discharge tube for a high pressure discharge lamp. Further, in FIG. 8, as an end portion 5*c* has a construction which is the same as that of an end portion 5*d,* only the end portion 5*c* is described.

In FIG. 8, the vessel 4 has the main body 10, a plugging member made of the alumina, and a capillary 16*c*. A composite electrode 6*c* has a cylindrical current conductor 13*c* with a diameter which is smaller than a diameter of the opening portion of the plugging member 11*c,* and a electrode 14*c* jointed by welding at a bottom of the current conductor 13*c* exposed to inside of the vessel 4. In this case, also, the electrode 14*c* has a coil 15*c*. Further, a gap between the second composite electrode 6*c* and the capillary 16*c* is gas tightly sealed by welding.

Also, the current conductor 13*b* of the second composite electrode 6*b* has the cylindrical member, and the metallizing layer composed of the mixture of the molybdenum and the alumina.

According to the embodiment, as only the proximity of the opening portion of one end of the vessel is heated in a moment, an ionizable light-emitting material and a starting gas may not leak to outside of the vessel.

Figure 9A:
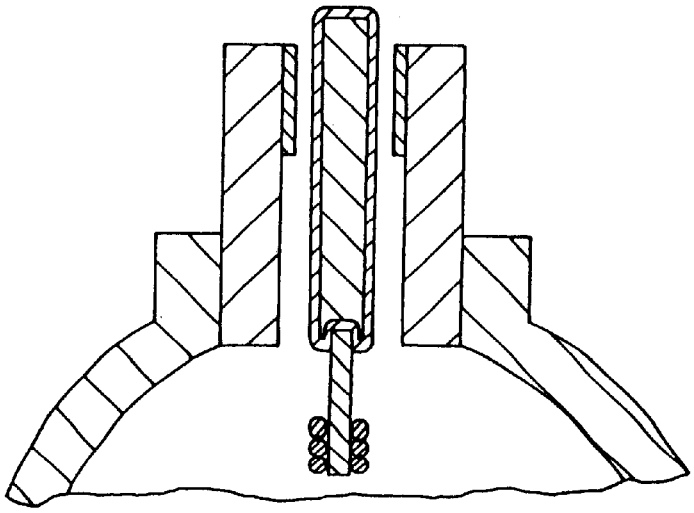
FIGS. 9A to 9G show another examples at the end of the vessel in second embodiment.
Figure 9B:
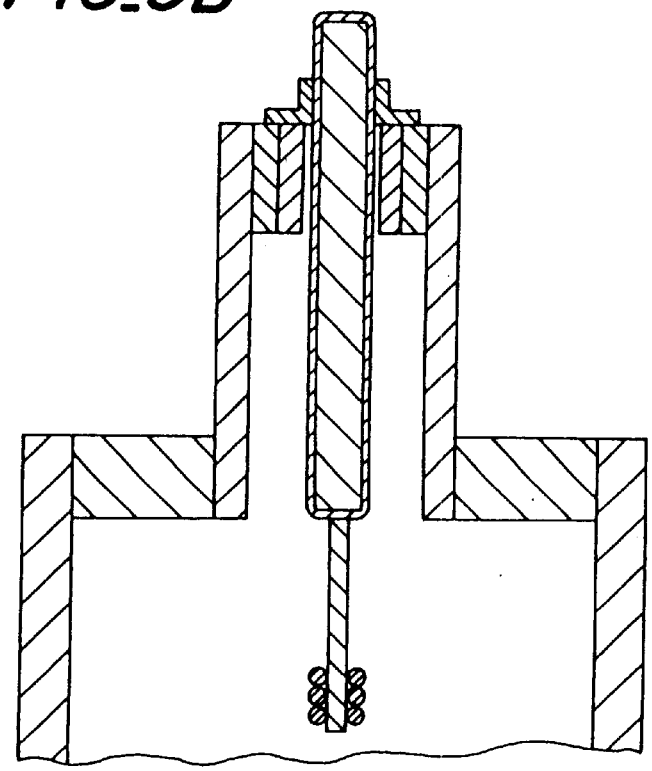
Figure 9C:
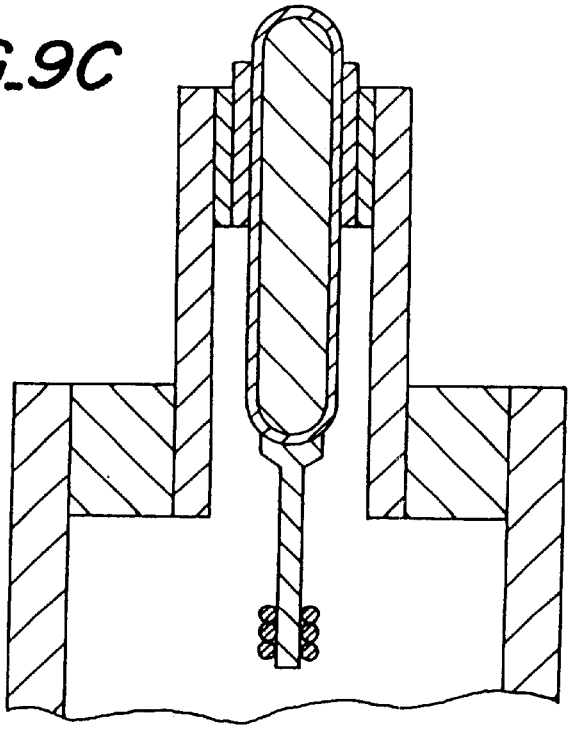
Figure 9D:
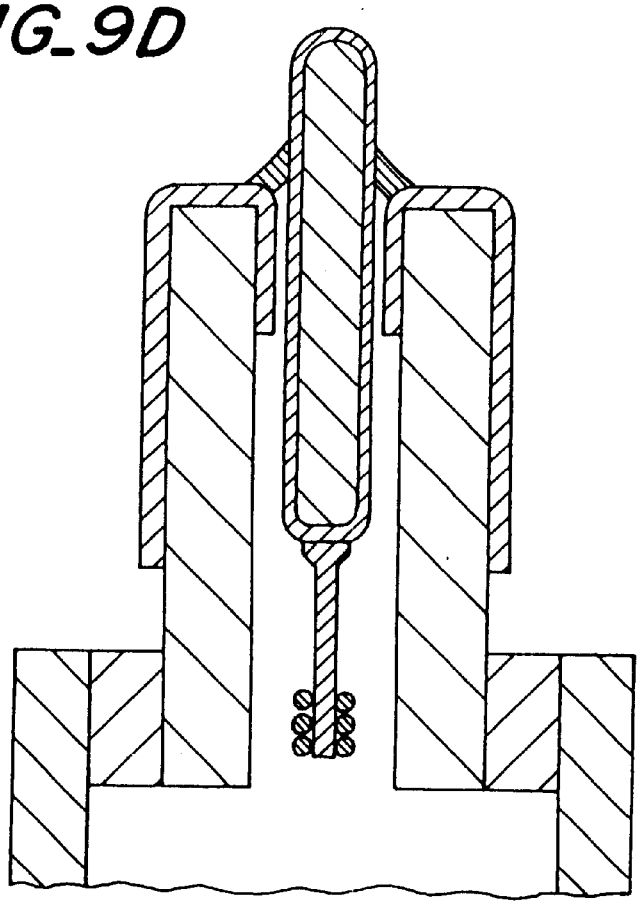
Figure 9E:
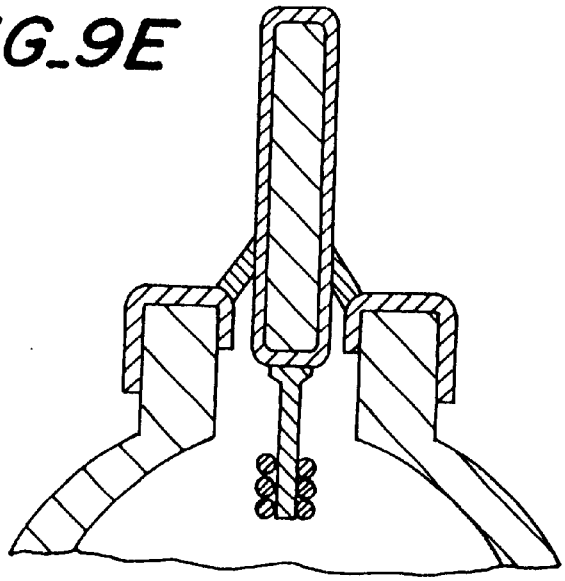
Figure 9F:
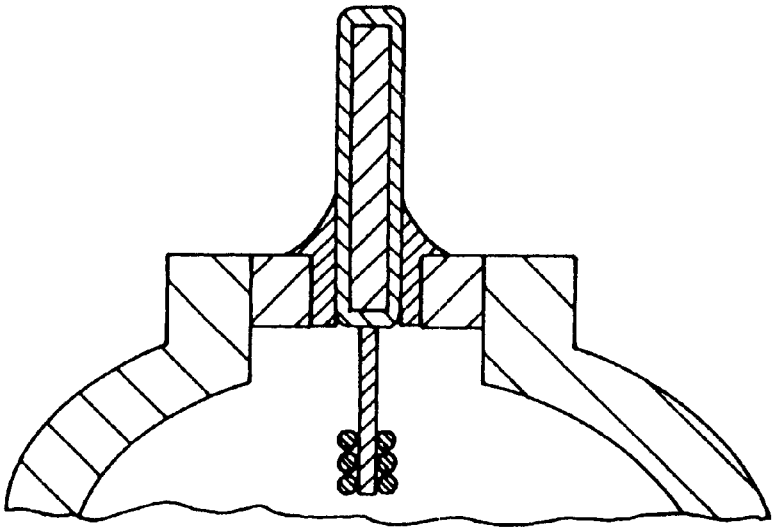
Figure 9G:
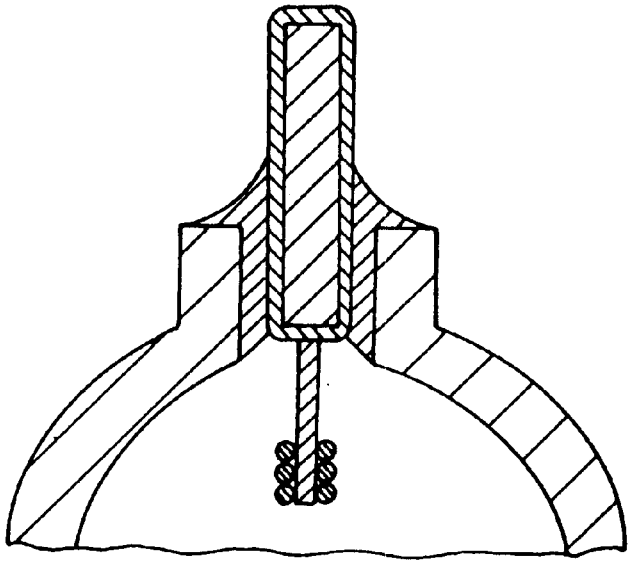

FIGS. 9A to 9G show another examples at the end of the vessel in second embodiment. In FIG. 9A, a composite electrode which has a electrode buried in a concave portion at the bottom of a current conductor is used as the composite electrode, and a gap between the composite electrode and the opening portion is gas tightly sealed by welding. In FIGS. 9A and 9B, the metallizing layer is formed, and the molybdenum is provided between the composite electrode and the capillary by brazing. In FIGS. 9D and 9E, a layer for melting is provided between an extending conductive layer for earth and the conductive layer. In FIGS. 9F and 9C, the capillary is not provided at the end.

Figure 10A:
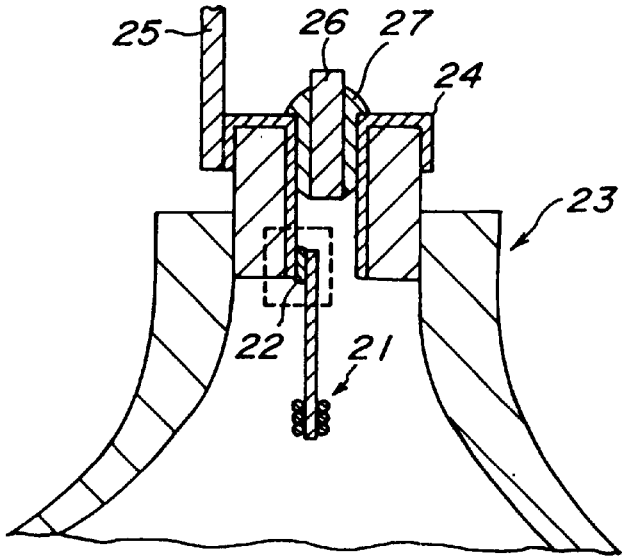
FIGS. 10A to 10H are views showing third embodiment of the invention.
Figure 10B:
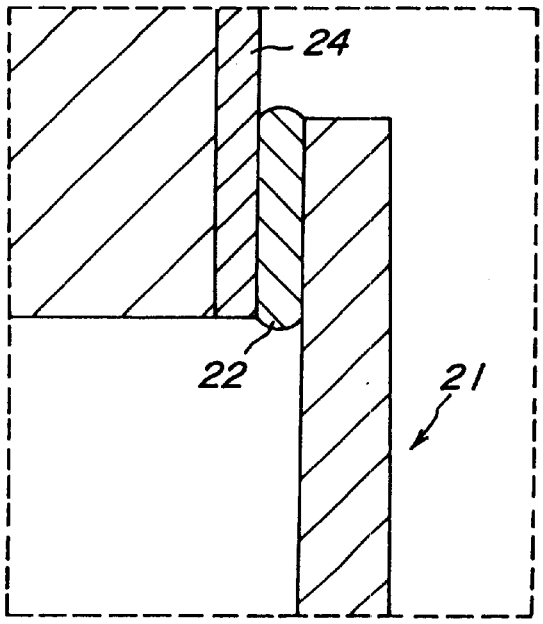

FIG. 10A is a view showing an example of an end of a vessel in accordance with a third embodiment of the invention, and FIG. 10B is a part thereof in enlarged scale. In this case, an electrode 21 is jointed at a metallizing coating portion 24 (which is composed of molybdenum or a mixture of molybdenum and alumina, for example) coated on the proximity of an opening portion at one end of a vessel 13 with a metallizing portion 22 composed of a mixture of a metal (molybdenum, for example) and a non-conductive material (the mixture is composed of molybdenum and alumina, for example), so that the electrode 21 electrically connects to a lead 25. Further, the vessel 23 and a plug 26 made of alumina whose diameter is smaller than a diameter of the opening portion at one end of the vessel 13 are so arranged relative to each other as leave a gap therebetween, with the plug 26 inserted into the opening portion at one end of the vessel 23 filled with a light-emitting material, the gap is gas tightly sealed with a frit seal 27.

In the case where the electrode 21 is jointed at the proximity of the opening portion with the metallizing portion 22 in such a manner, an area contacting the mixture 22 to the proximity of the opening portion is enough, so that a bonding strength of the electrode 21 improves.

Figure 10C:
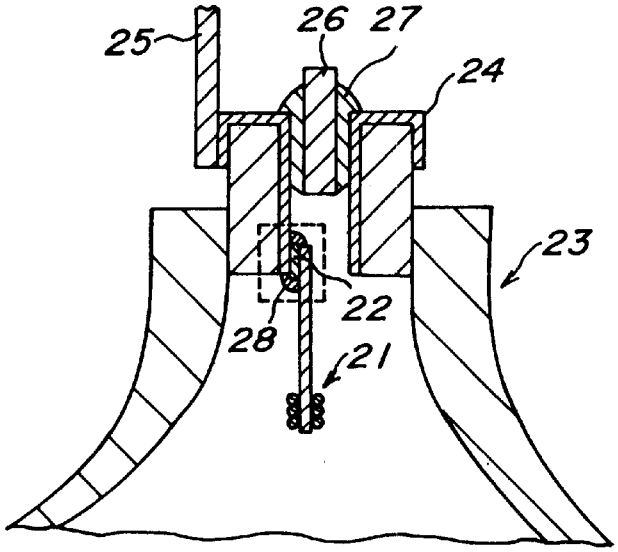
Figure 10D:
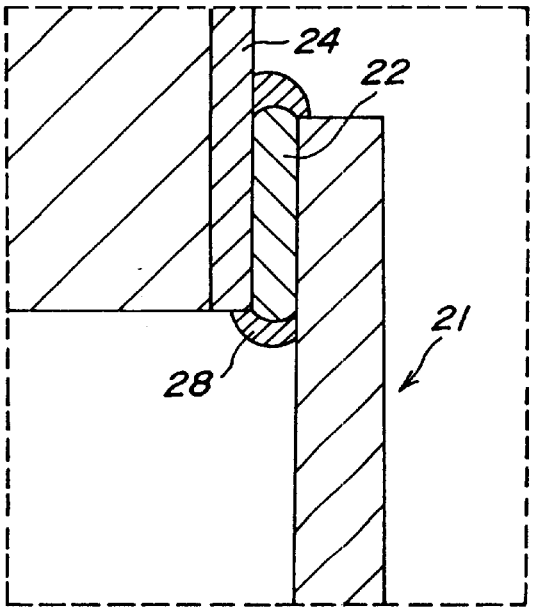

FIG. 10C is a view showing another example of an end of a vessel in accordance with a third embodiment of the invention, and FIG. 10D is a part thereof in enlarged scale. In this case, by coating a material which has a higher melting point and/or a higher corrosion resistance than the metal or the mixture of the metal and the non-conductive material which compose of the metallizing portion 22 (that material is composed of tungsten or a mixture of tungsten and alumina, for example), the bonding strength and/or the corrosion resistance of the electrode 21 further improve(s).

Figure 10E:
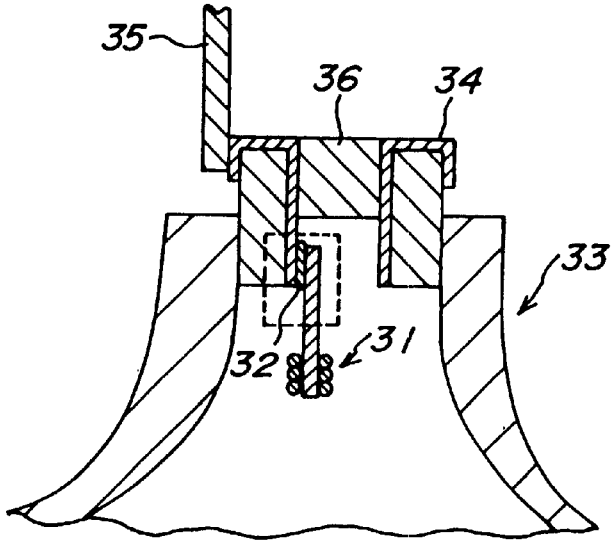
Figure 10F:
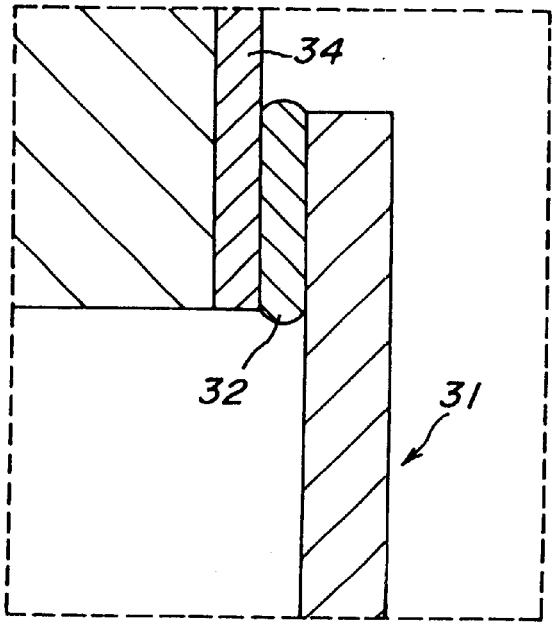

FIG. 10E is a view showing another example of an end of a vessel in accordance with a third embodiment of the invention, and FIG. 10F is a part thereof in enlarged scale. In this case, an electrode 31 is jointed at a metallizing coating portion 34 (which is composed of molybdenum or a mixture of molybdenum and alumina, for example) coated on the proximity of an opening portion at one end of a vessel 33 with a metallizing portion 32 composed of a mixture of a metal (molybdenum, for example) and a non-conductive material (the mixture is composed of molybdenum and alumina, for example), so that the electrode 31 electrically connects to a lead 35. Further, the vessel 33 and a plug 36 made of alumina which has a substantially same diameter as a diameter of the opening portion have been subjected to a co-firing into an integrated body, with the plug 36 at one end of the vessel 33.

In this case, also, as the electrode 31 is jointed at the proximity of the opening portion with the metallizing portion 32, the bonding strength of the electrode improves.

Figure 10G:
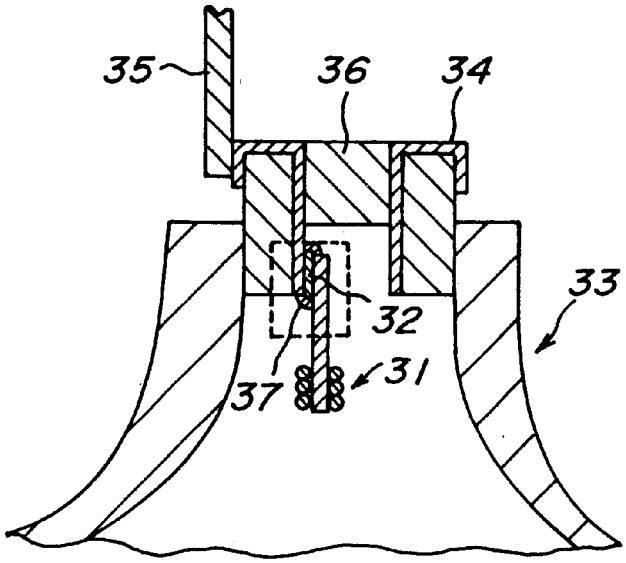
Figure 10H:
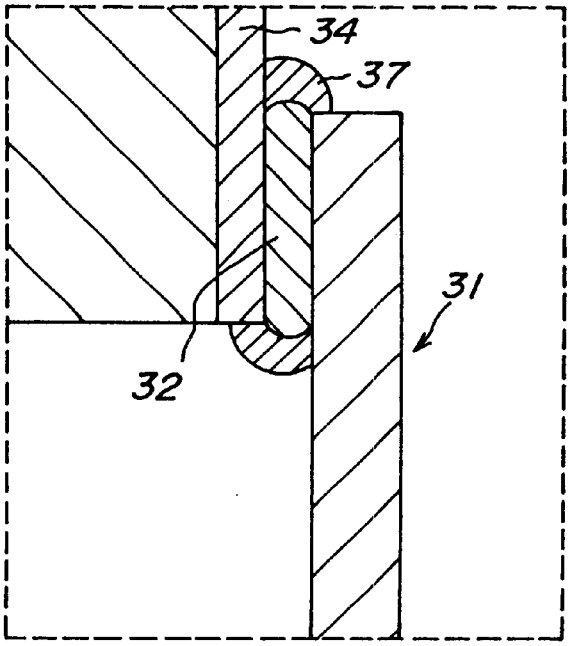

FIG. 10G is a view showing another example of an end of a vessel in accordance with a third embodiment of the invention, and FIG. 10H is a part thereof in enlarged scale. In this case, by coating a material which has a higher melting point and/or a higher corrosion resistance than the metal or the mixture of the metal and the non-conductive material which compose of the metallizing portion 32 (that material is composed of tungsten or a mixture of tungsten and alumina, for example), the bonding strength and/or the corrosion resistance of the electrode 31 further improve(s).

FIGS. 11A to 11K are view for showing a composite electrode for a high pressure discharge lamp according to the invention.

Figure 11A:
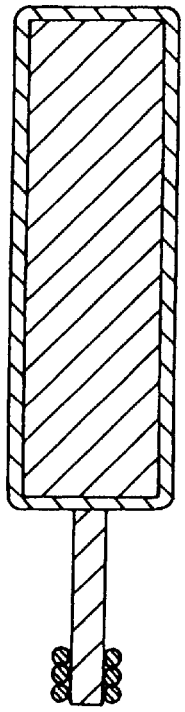
FIGS. 11A to 11K are views for showing a composite electrode for a high pressure discharge lamp according to the invention.
Figure 11B:
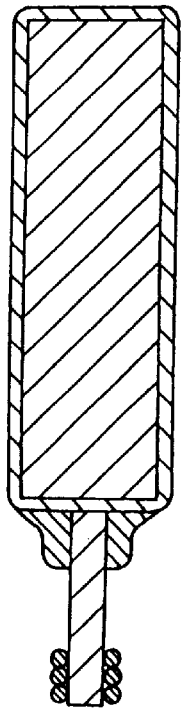
Figure 11C:
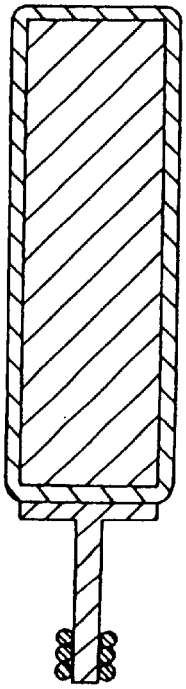
Figure 11D:
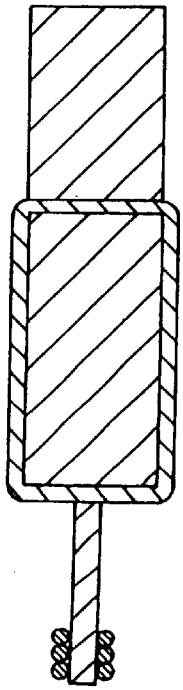

In FIG. 11A, a rod-shaped electrode is jointed to the current conductor by welding. In FIG. 11B, the rod-shaped electrode is jointed to the current conductor by metallizing. In FIG. 11C, an electrode having a rod-shaped portion and a disk portion is jointed to the current conductor by metallizing. In FIG. 11D, a rod made of a niobium is jointed to the end of the current conductor.

Figure 11E:
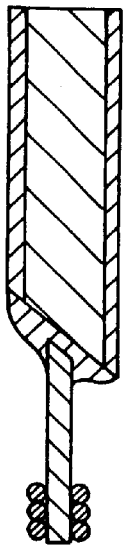

In FIG. 11E, a substantially cylindrical member made of a non-conductive material (alumina, for example) which is coated with a mixture of a metal and a non-conductive material (molybdenum and alumina, for example) on only a tubular surface thereof has one bottom inclined to an axis thereof, and an electrode is jointed at the inclined bottom with the mixture. In this case, an area contacting the mixture at the inclined bottom is wider than the case where a bottom thereof is perpendicular to an axis thereof provided that a diameter of the substantially cylindrical member whose bottom is inclined to an axis thereof is the same as that whose bottom is perpendicular to an axis thereof, so that the bonding strength improves.

Figure 11F:
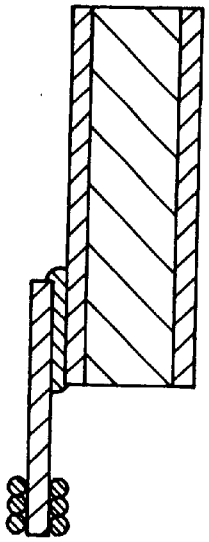

In FIG. 11F, a cylindrical member made of a non-conductive material (alumina, for example) is coated with a mixture of a metal and a non-conductive material (molybdenum and alumina, for example) on only a tubular surface thereof, and an electrode is jointed at a side of the cylindrical member with the mixture. By jointing the electrode at the side of the cylindrical member, the bonding strength can be higher than the case where the electrode is jointed at a bottom of the cylindrical member.

Figure 11G:
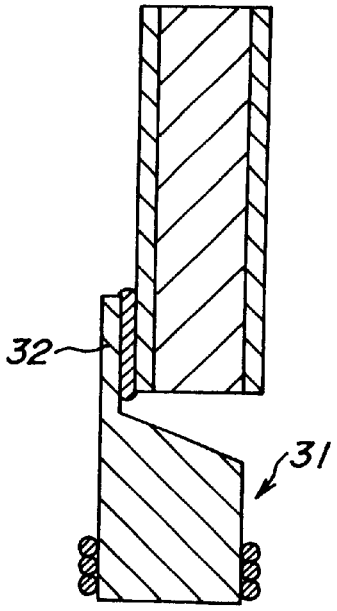

In FIG. 11G, a cylindrical member made of a non-conductive material (alumina, for example) is also coated with a mixture of a metal and a non-conductive material (molybdenum and alumina, for example) on only a tubular surface thereof, and an electrode 31 is jointed at a side of the cylindrical member with the mixture. A part of a pointed end portion of the electrode 31 is cut off and a pointed end portion 32 which extends so as to shift a center axis of the electrode is jointed at a side of the cylindrical member. In this case, also. by jointing the electrode at the side of the cylindrical member, the bonding strength can be higher than the case where the electrode is jointed at a bottom of the cylindrical member. Moreover, such an axis of the electrode 31 can easily correspond to an axis of an electrode to be opposite to the electrode 31.

Figure 11H:
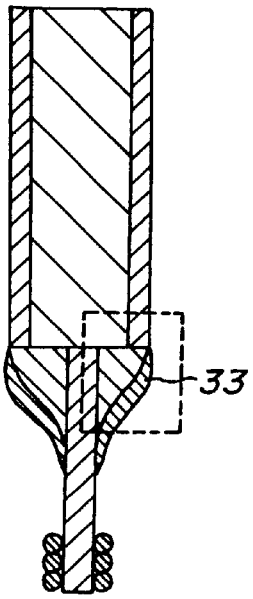
Figure 11I:
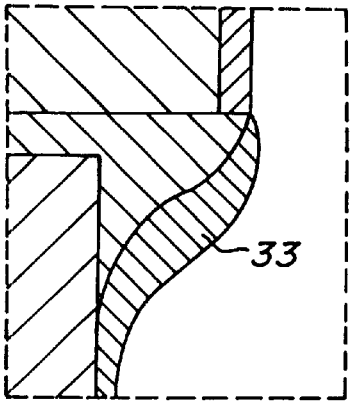
Figure 11J:
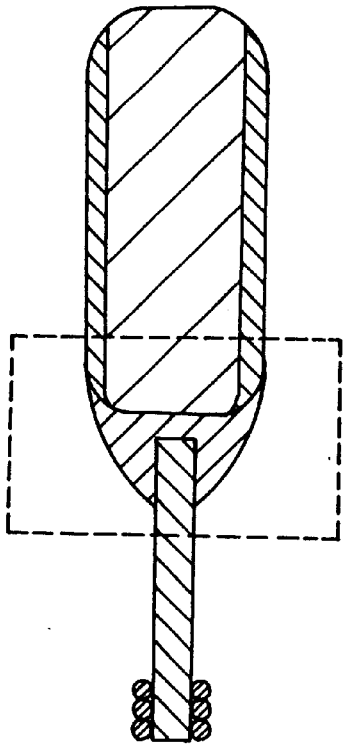
Figure 11K:
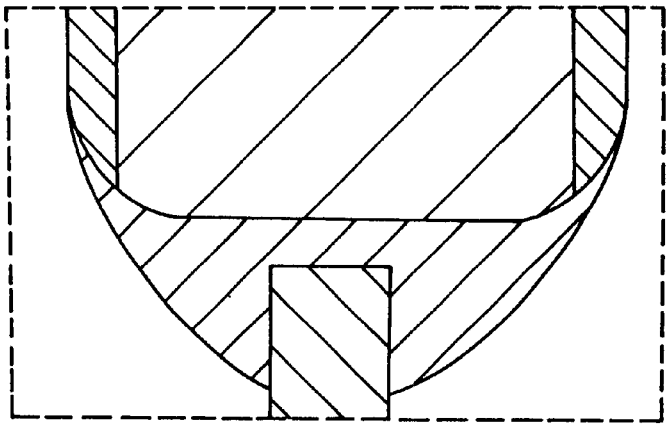

In FIG. 11H, a cylindrical member made of a non-conductive material (alumina, for example) is also coated with a mixture of a metal and a non-conductive material (molybdenum and alumina, for example) on only a tubular surface thereof, and an electrode is jointed at a bottom of the cylindrical member with the mixture. A jointing portion therebetween and the proximity thereof are coated with a material 33 having a higher melting point and/or a higher corrosion resistance than the mixture (that material is tungsten or a mixture of tungsten and alumina). FIG. 11I is a part of FIG. 11H in enlarged scale. In this way, the bonding strength and/or the corrosion resistance can further improve. In FIG. 11J, a cylindrical member made of a non-conductive material (alumina, for example) which has a rounded end is also coated with a mixture of a metal and a non-conductive material (molybdenum and alumina, for example) on only a tubular surface thereof and an electrode is jointed at a bottom of the cylindrical member with the mixture. FIG. 11K is a part of FIG. 11J in enlarged scale. In this case, as an area contacting the mixture at the substantially cylindrical member increases, a bonding strength improves, and as an area contacting the mixture for jointing to the mixture coated on the side thereof increases, the conductivity improves. In this case, also, as is shown in FIGS. 11H and 11I, a material having a higher melting point and/or a higher corrosion resistance than the mixture (that material is tungsten or a mixture of tungsten and alumina) can be coated on the joint portion therebetween and the proximity thereof.

Next, a relation between vol. % of the molybdenum and that of the alumina, and those conductivity and gas tight property is shown in Table 1. In Table 1, for example, 20/80 denotes that the content of the molybdenum is 20 vol. %, and the content of the alumina is 80 vol. %.

TABLE 1

| volume ratio vol. % | conductivity | tight property |
|---|---|---|
| 20/80 | X | ◎ |
| 30/70 | Δ | ◎ |
| 40/60 | ○ | ◎ |
| 50/50 | ◎ | ◎ |
| 60/40 | ◎ | ○ |
| 70/30 | ◎ | Δ |
| 80/20 | ◎ | X |

◎ . . . excellent ○ . . . good Δ unstable X . . . no good

According to Table 1, it is found that a preferable volume ratio is 30/70 to 70/30.

Next, a relation between a thickness of the metallizing layer, and a conductivity and gas tight property thereof is shown in Table 2.

In this case, the gas tight property is judged with a He leak detector.

TABLE 2

| thickness (μm) | conductivity | tight property |
|---|---|---|
| 3 | X | ◎ |
| 5 | Δ | ◎ |
| 10 | Δ | ◎ |
| 20 | ○ | ◎ |
| 30 | ◎ | ◎ |
| 50 | ◎ | ◎ |
| 100 | ◎ | ○ |
| 200 | ◎ | Δ |
| 400 | ◎ | Δ |
| 600 | ◎ | X |

◎ . . . excellent ○ . . . good Δ . . . unstable X . . . no good

According to Table 2, it is found that a preferable thickness of the metallizing layer is 20 to 400 μm.

Next, a first embodiment of a process for manufacturing the high pressure discharge lamp is described with FIGS. 2B and 4A.

First, the main body 10 is formed. A molded body formed as such is dewaxed and calcined to obtain a aligned body. Also, an alumina powder is molded to obtain a ring shaped plugging member 11*a*. Preferably, the plugging member 11*a* obtained as such is dewaxed and calcined to obtain a calcined body.

Next, the calcined body of the plugging member 11*a* is inserted into an end of the calcined body of the main body 10 to set it to a certain position, and the main body 10 and the plugging member 11*a* are calcined to obtain a calcined body of the vessel 4.

Next, the first composite electrode 6*a* formed as described later is inserted into the opening portion of the plugging member 11*a* such that the electrode 15*a* is exposed to the inner space of the vessel 4 and one end of the first composite electrode 6*a* is exposed to outside of the vessel 4, and co-firing the vessel 4 and the first composite electrode 6*a* into an integrated body. Then, the second composite electrode 6*b* is inserted into the opening portion of the plugging member 11*b* such that the electrode 15*b* is exposed to the inner space and one end of the second composite electrode 6*b* is exposed to outside, and the gap between the current conductor 13*b* and the vessel is gas tightly sealed with the frit seal.

Next, a second embodiment of a process for manufacturing the high pressure discharge lamp is described with FIG. 8.

First, the main body 10 is formed. A molded body formed as such is dewaxed and calcined to obtain a calcined body. Also, an alumina powder is molded to obtain a ring shaped plugging member 11*c* and the capillary 16*c*. Preferably, the plugging member 11*c* and the capillary 16*c* obtained as such are dewaxed and calcined to obtain calcined bodies.

Next, the calcined body of the plugging member 11*c* is inserted into an end of the calcined body of the main body 10 to set it to a certain position, the calcined body of the capillary 16*c* is inserted into an opening portion of the plugging member 11*c* to set it to a certain potion, and the main body 10, the plugging member 11*c* and the capillary 16*c* are calcined to obtain a calcined body of the vessel 4.

Next, the composite electrode 6*c* is inserted into the opening portion of the capillary 16*c* such that the electrode 15*c* is exposed to the inner space and one end of the composite electrode 6*c* is exposed to outside, and the gap between the current conductor 13*c* and the vessel is gas tightly sealed with the molybdenum layer and the layer of the mixture of the molybdenum and the alumina.

The process for manufacturing the composite electrode will be described with FIGS. 12A to 12D.

Figure 12A:
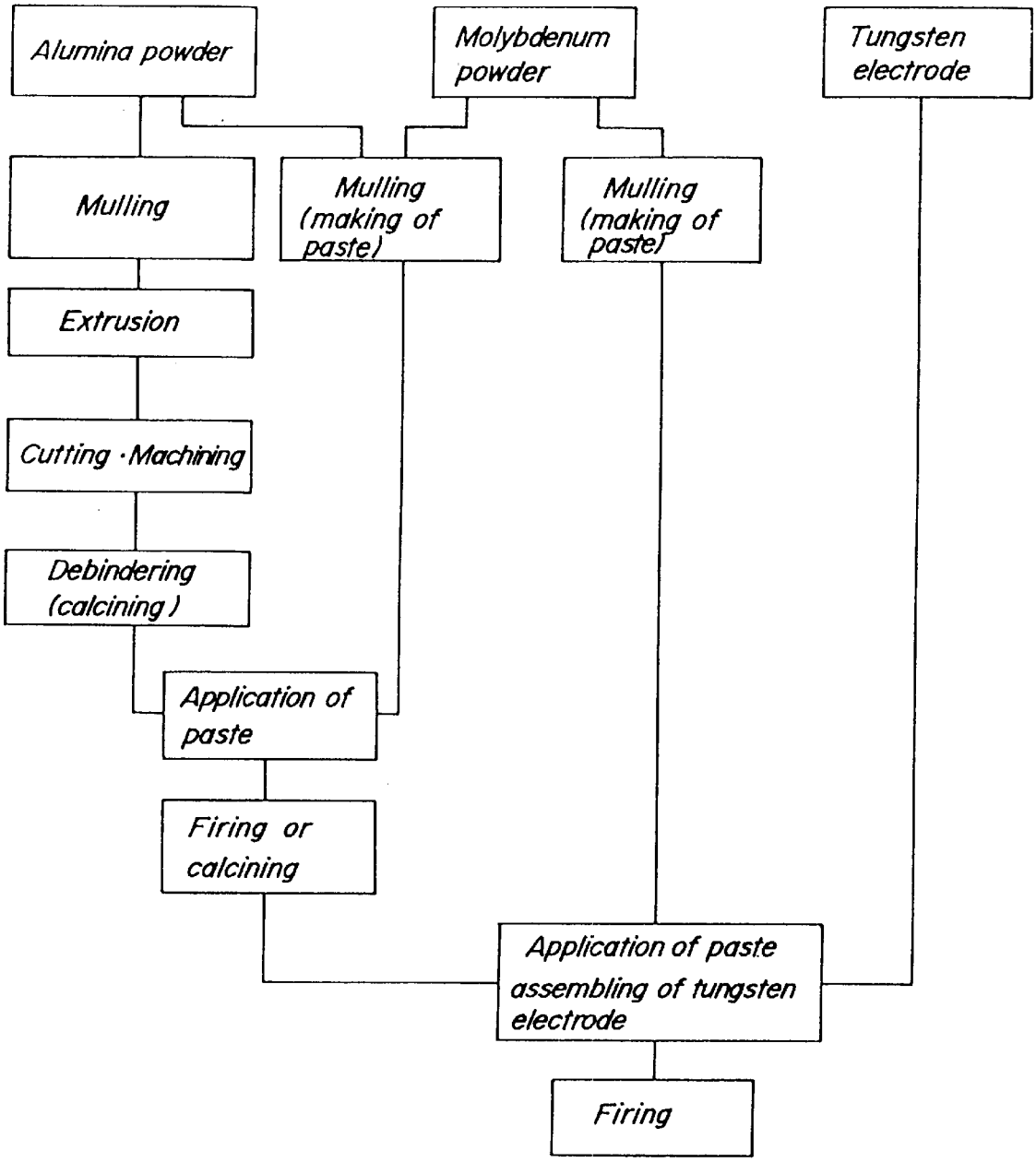
FIGS. 12A to 12C are flow charts illustrating the process for manufacturing the composite electrode.

In a flow chart in FIG. 12A, first, an alumina powder is mullited and press molded to obtain a molded body, and then, the molded body is cut and processed. In this case, the process is mainly outer peripheral process (centerless, etc), and the cutting can be done in advance of the processing or the processing can be done in advance of the cutting. Then a binder is removed from the molded body, and the body is calcined by request.

Next, the calcined body is applied with a paste of the alumina powder and the molybdenum powder, and the body formed as such is fired or calcined.

Next, the calcined body is applied with a paste of the molybdenum powder, the body formed as such and the electrode made of the tungsten are assembled into one body, and the body is fired.

Figure 12B:
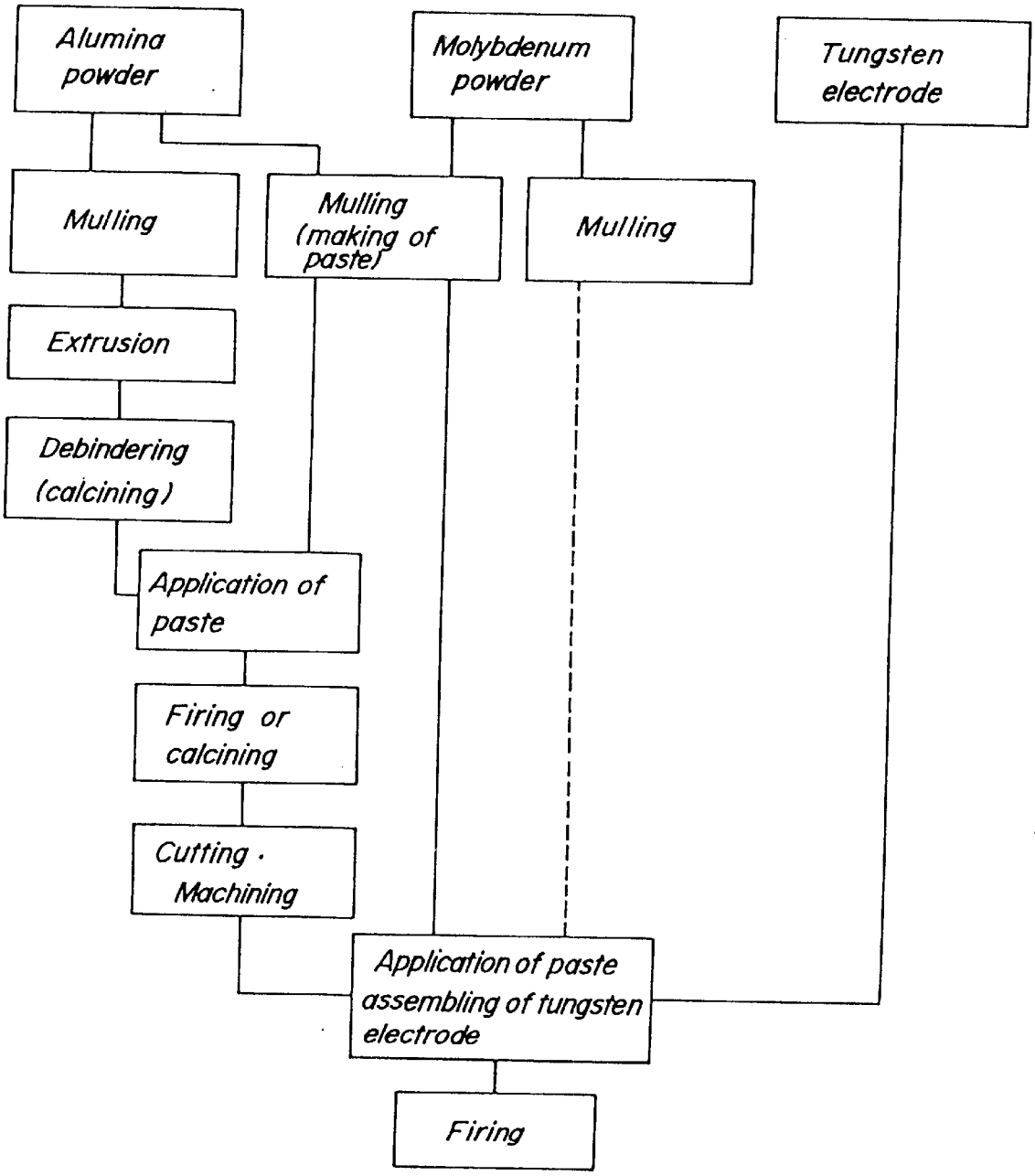

Also, the composite electrode according to the invention can be manufactured in accordance with a flow chart shown in FIG. 12B.

In this case, the cutting and processing process is done after the firing or calcining process, the mulling of the molybdenum powder is used by required in the paste applying and assembling of the tungsten electrode process.

Figure 12C:
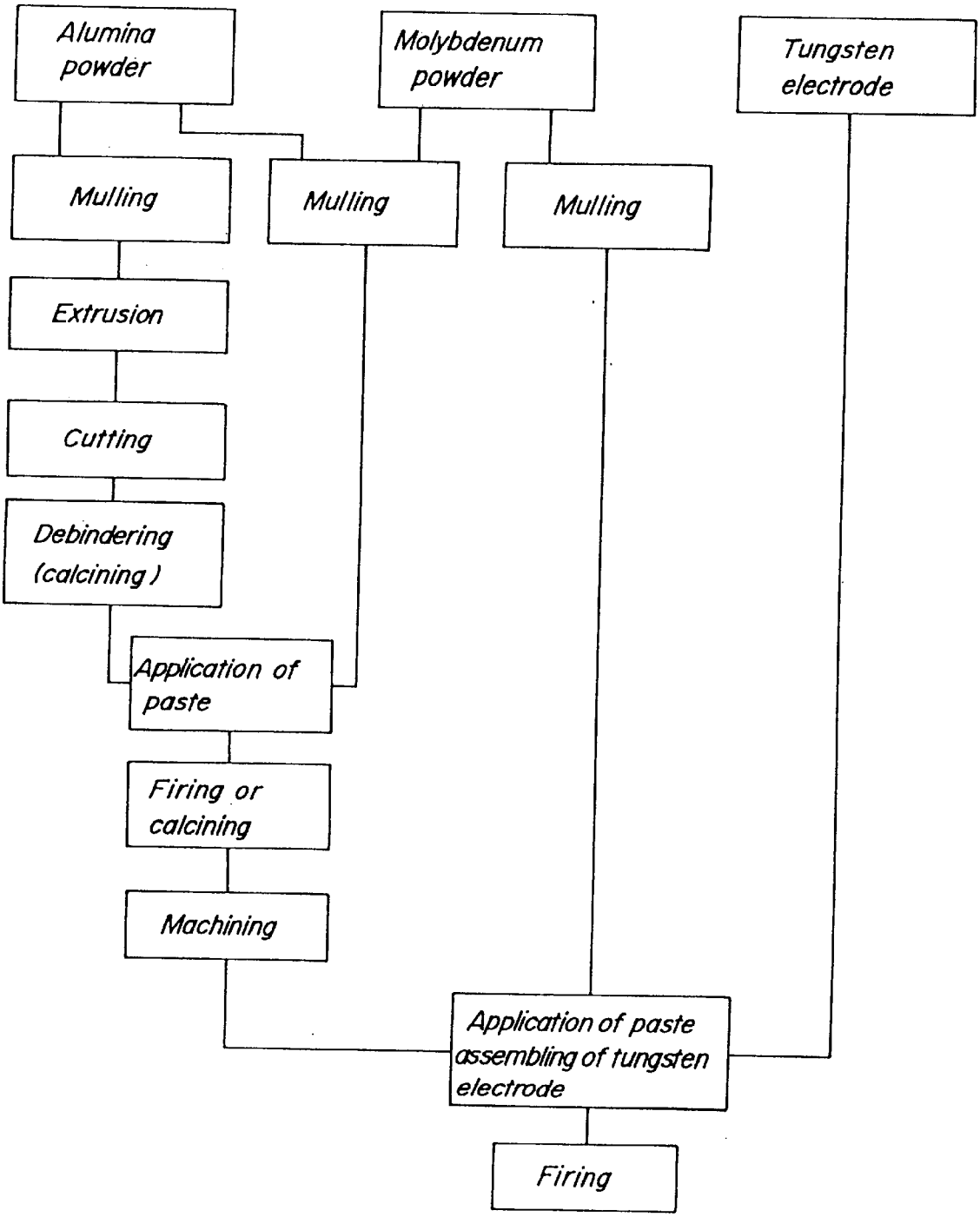

Also, the composite electrode according to the invention can be manufactured in accordance with a flow chart shown in FIG. 12C.

In this case, after the cutting process, the extrusion process follows. After the firing or calcining process, the processing process follows.

Figure 13:
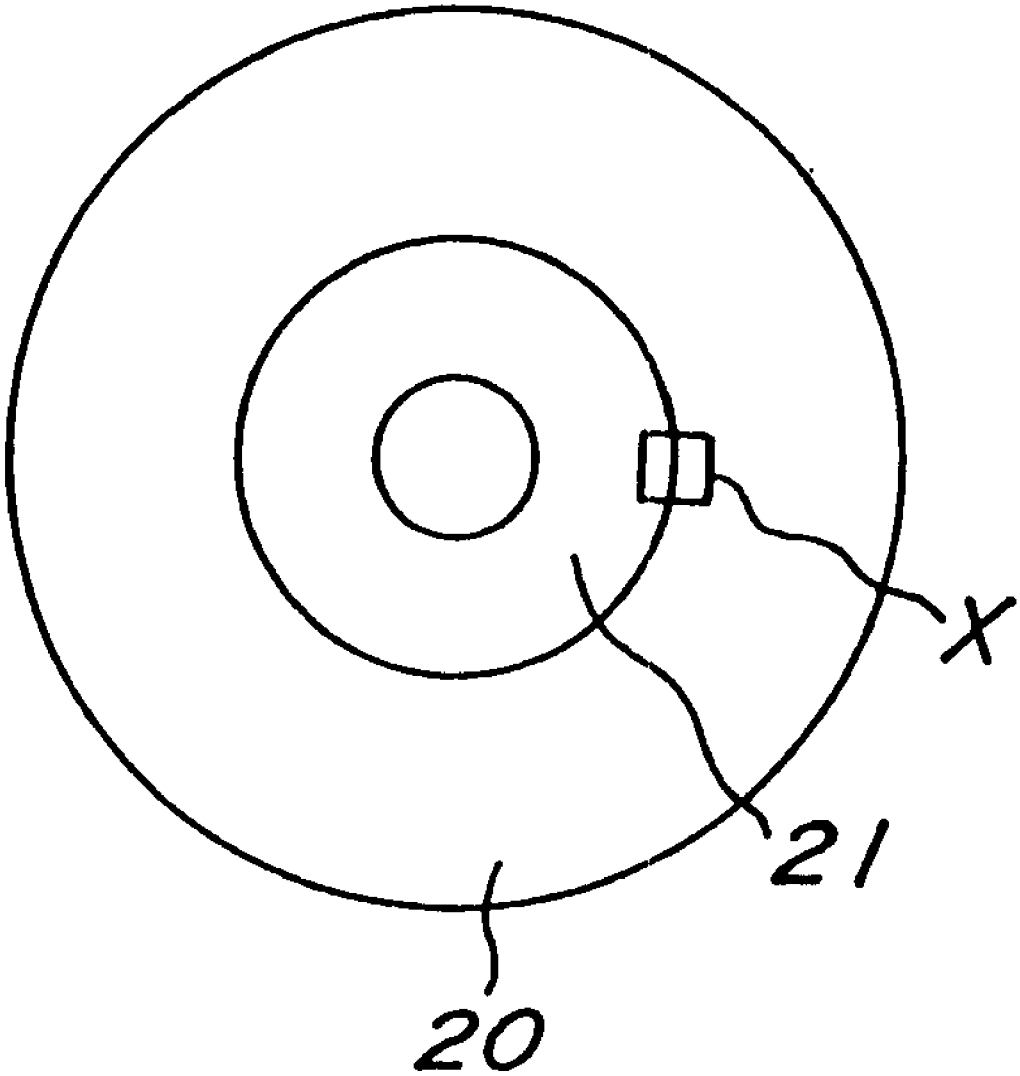
FIG. 13 is a view for describing comparison of a prior high pressure discharge lamp and a high pressure discharge lamp according to the invention.

FIG. 13 is a view for describing comparison of a prior high pressure discharge lamp and a high pressure discharge lamp according to the invention.

For comparing the prior high pressure discharge lamp with the high pressure discharge lamp according to the invention, a capillary 21 coated with the metallizing layer over a surface thereof is inserted into an opening portion of a tubular member 20, and the tubular member 20 and the capillary 21 are co-fired into an integrated body.

The following member is used as the capillary 21.

i) A body having a tubular member made of the alumina coated by a mixture of 60 vol. % of the tungsten and 40 vol. % of the alumina (hereinafter, called "capillary i").

ii) A body having a tubular member made of the alumina coated by a mixture of 50 vol. % of the molybdenum and 50 vol. % of the alumina with a thickness of 30 $\mu$m (hereinafter, called "capillary ii").

iii) A body having a tubular member made of the alumina coated by a mixture of 50 vol. % of the molybdenum and 50 vol. % of the alumina with a thickness of 50 $\mu$m hereinafter, called "capillary iii").

iv) A body having a tubular member made of the alumina coated by a mixture of 80 vol. % of the molybdenum and 20 vol. % of the alumina with a thickness of 50 $\mu$m (hereinafter, called "capillary iv").

v) A body having a tubular member made of the alumina coated by a mixture of 20 vol. % of the molybdenum and 80 vol. % of the alumina with a thickness of 30 $\mu$m (hereinafter, called "capillary v").

FIGS. 14A to 14E are photomicrographs for describing comparison of a prior high pressure discharge lamp and a high pressure discharge lamp according to the invention. The photomicrographs show a portion X in FIG. 13A.

Figure 14A:
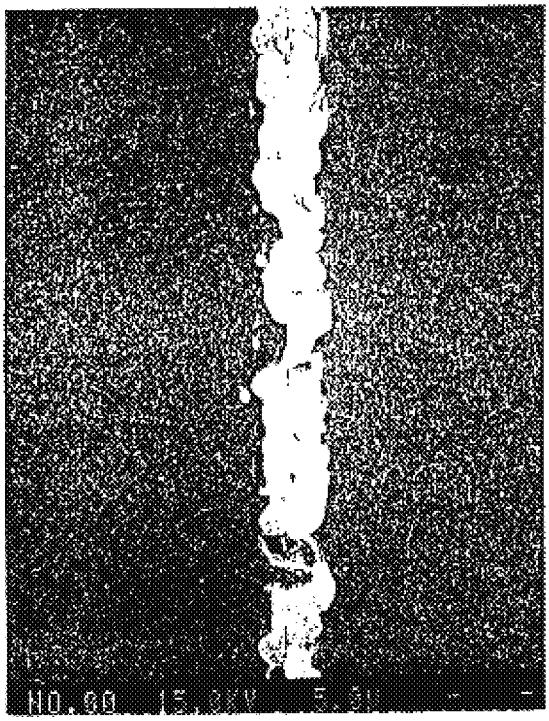
FIGS. 14A to 14E are photomicrographs for describing comparison of a prior high pressure discharge lamp and a high pressure discharge lamp according to the invention.

FIG. 14A shows that the capillary i and the tubular member 20 are co-fired into an integrated body. Judging from this, it is found that a joining structure between the capillary i and the tubular member 20 is no good.

Figure 14B:
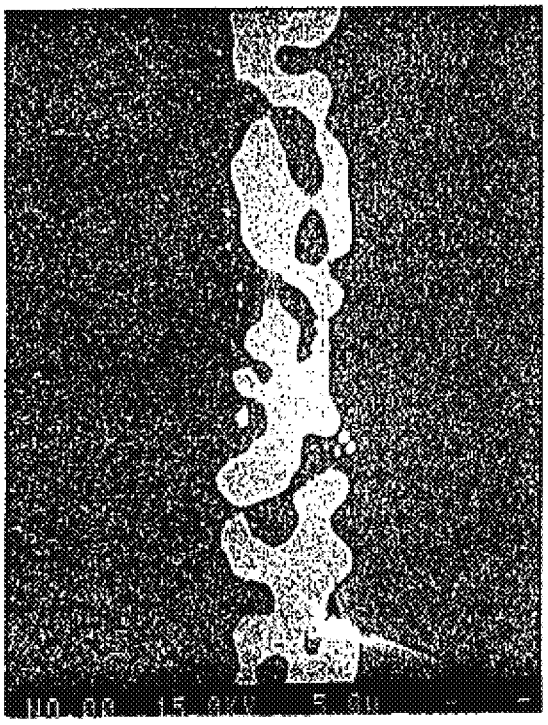

FIG. 14B shows that the capillary ii and the tubular member 20 are co-fired into an integrated body. Judging from this, it is found that a joining structure between the capillary ii and the tubular member 20 is good.

Figure 14C:
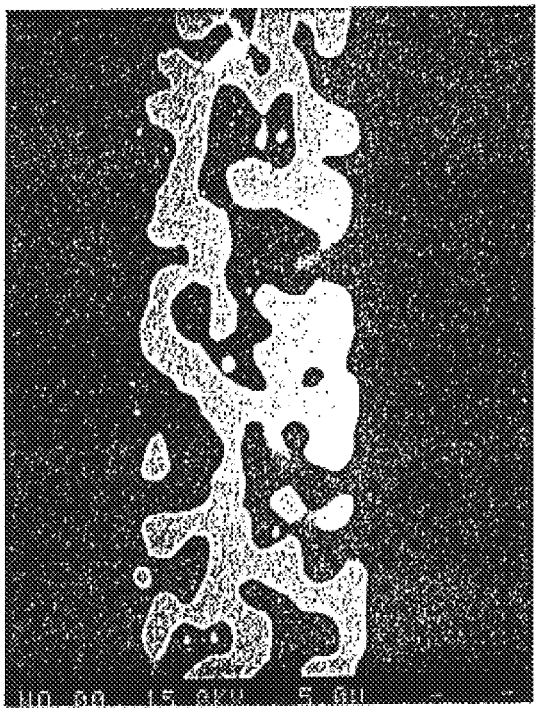

FIG. 14C shows that the capillary iii and the tubular member 20 are co-fired into an integrated body. Judging from this, it is found that a joining structure between the capillary iii and the tubular member 20 is good.

Figure 14D:
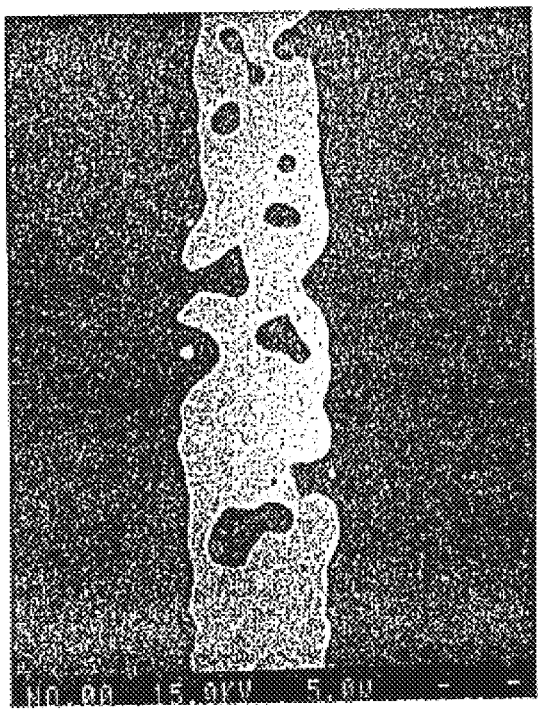

FIG. 14D shows that the capillary iv and the tubular member 20 are co-fired into an integrated body. Judging from this, it is found that a joining structure between the capillary iv and the tubular member 20 is no good.

Figure 14E:
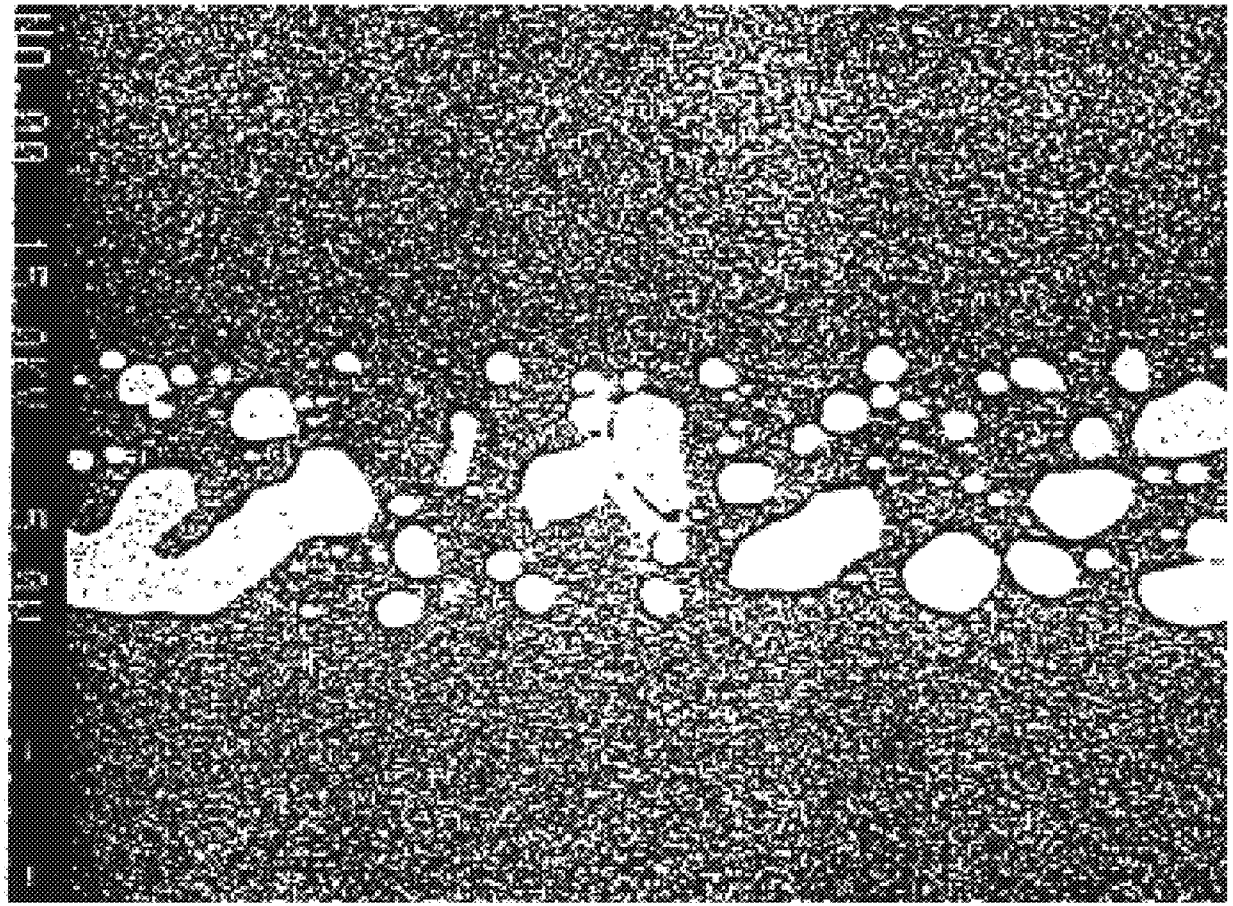

FIG. 14E shows that the capillary v and the tubular member 20 are co-fired into an integrated body. Judging from this, it is found that the metallizing layer is discontinuous.

The present invention is not limited to above embodiments, other modifications will be apparent by those skilled in the art.

For example, as the non-conductive material composing the vessel and the cylindrical member, a non-conductive material other than the alumina (e.g. cement) is used Also in the above embodiments, although the metallizing layer is formed with the mixture of the molybdenum and the alumina, the metal of the mixture may contain not less than 50 vol. % of the molybdenum and the non-conductive material of the mixture may contain not less than 50 vol. % of a material which is the same as that forming the vessel (in above embodiment, alumina).

Also, in the first embodiment, when the gap between the second composite electrode and the vessel is tightly sealed, instead of using the frit seal, the gap may be tightly sealed with a layer made of the molybdenum or a layer made of the molybdenum and the alumina.

Also, in the above embodiment, when the composite electrode and the vessel are co-fired into an integrated body, the main body and the plugging member are calcined with the plugging member inserted into the end of the main body, a calcined body obtained as such is fired with the composite electrode inserted into an opening portion of the calcined body. However, the plugging member and the composite electrode are calcined with the composite electrode inserted into an opening of the plugging member, a calcined body obtained as such and the main body are fired with the calcined body inserted into the end of the main body.

Also, for manufacturing the composite electrode, a magnesium oxide may be added to the alumina powder.

What is claimed is:

1. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is substantially the same as a diameter of the opening portion at one end of the vessel, and an electrode jointed by welding or metallizing at a bottom or a side of the current conductor exposed to inside of the vessel;

said current conductor of the composite electrode being formed by a substantially cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner surface with one end of the composite electrode is exposed to outside of the vessel.

2. A high pressure discharge lamp according to claim 1, wherein at least one end of the current conductor exposed to inside of the vessel is rounded, the electrode is jointed by metallizing at the rounded end.

3. A high pressure discharge lamp according to claim 1, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

4. A high pressure discharge lamp according to claim 1, at least one end of the current conductor exposed to inside of the vessel is rounded, the electrode is jointed at the rounded by metallizing at the rounded end, a metal or a mixture of a metal and a non-conductive material having at least one of a higher melting point and/or a higher corrosion resistance than a metal or a mixture of a metal and a non-conductive material jointing the electrode and the current conductor is coated on the joint portion of the electrode and the current conductor and the proximity thereof.

5. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is smaller than a diameter of the opening portion at one end of the vessel, and an electrode jointed by welding or metallizing at a bottom or a side of the current conductor exposed to inside or the vessel;

said current conductor of the composite electrode being formed by a substantially cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space with one end of the composite electrode is exposed to outside of the vessel, said gap being tightly sealed with a metallic layer or a layer made of a mixture of a metal and a material which is same as that forming said vessel.

6. A high pressure discharge lamp according to claim 5, wherein at least one end of the current conductor exposed to inside of the vessel is rounded, the electrode is jointed by metallizing at the rounded end.

7. A high pressure discharge lamp according to claim 5, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

8. A high pressure discharge lamp according to claim 5, at least one end of the current conductor exposed to inside of the vessel is rounded, the electrode is jointed at the rounded by metallizing at the rounded end, a metal or a mixture of a metal and a non-conductive material having at least one of a higher melting point and a higher corrosion resistance than a metal or a mixture of a metal and a non-conductive material jointing the electrode and the current conductor is coated on the joint portion of the electrode and the current conductor and the proximity thereof.

9. A high pressure discharge lamp comprising:

a vessel made of a non-conductive material which forms an inner space filled with an ionizable light-emitting material and a starting gas, and has opening portions at both ends thereof;

a first composite electrode having a substantially cylindrical current conductor with a diameter which is substantially the same as a diameter of the opening portion at one end of the vessel, and an electrode jointed by welding or metallizing at a bottom or a side of the current conductor exposed to the inside of the vessel; and a second composite electrode having a substantially cylindrical current conductor with a diameter which is smaller than a diameter of the opening portion at the other end of the vessel, and an electrode jointed by welding or metallizing at a bottom or a side of the current conductor exposed to the inside of the vessel;

each of said first and second conductors of the composite electrode being formed by a substantially cylindrical member which is made of a non-conductive material and is coated with a first mixture of a metal and a non-conductive material over substantially all of a cylindrical surface thereof;

said metal of the mixture containing not less than 50 vol. % of molybdenum, and said non-conductive material of the first mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to leave a gap therebetween, with the second composite electrode inserted into the opening portion at the other end of the vessel so that the electrode is exposed to the inner space with one end of the second composite electrode is exposed to outside of the vessel, said gap being tightly sealed with a metallic layer or a layer made of a second mixture of a metal and a material which is same as that forming said vessel.

10. A high pressure discharge lamp according to claim 9, wherein at least one end of the current conductor exposed to inside of the vessel is rounded, the electrode is jointed by metallizing at the rounded end.

11. A high pressure discharge lamp according to claim 9, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

12. A high pressure discharge lamp according to claim 9, at least one end of the current conductor exposed to inside of the vessel is rounded, the electrode is jointed at the rounded by metallizing at the rounded end, a metal or a mixture of a metal and a non-conductive material having at least one of a higher melting point and a higher corrosion resistance than a metal or a mixture of a metal and a non-conductive material jointing the electrode and the current conductor is coated on the joint portion of the electrode and the current conductor and the proximity thereof.

13. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is substantially the same as a diameter of the opening portion at one end of the vessel and a bottom inclined to an axis thereof exposed to inside of the vessel, and an electrode jointed by welding or metallizing at a bottom or a side of the current conductor exposed to the inside of the vessel;

said current conductor of the composite electrode being formed by a cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the electrode is exposed to the inner space with one end of the composite electrode is exposed to outside of the vessel.

14. A high pressure discharge lamp according to claim 13, wherein at least one end of the current conductor exposed to inside of the vessel is rounded, the electrode is jointed by metallizing at the rounded end.

15. A high pressure discharge lamp according to claim 13, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

16. A high pressure discharge lamp according to claim 15, at least one end of the current conductor exposed to inside of the vessel is rounded, the electrode is jointed at the rounded by metallizing at the rounded end, a metal or a mixture of a metal and a non-conductive material having at least one of a higher melting point and a higher corrosion resistance than a metal or a mixture of a metal and a non-conductive material jointing the electrode and the current conductor is coated on the joint portion of the electrode and the current conductor and the proximity thereof.

17. A high pressure discharge lamp comprising:

a vessel made of a non-conductive material which forms an inner space filled with an ionizable light-emitting material and a starting gas, and has opening portions at both ends thereof; and a composite electrode having a substantially cylindrical current conductor with a diameter which is smaller than a diameter of the opening portion at one end of the vessel and a bottom inclined to an axis thereof exposed to the inside of the vessel, and an electrode jointed by welding or metallizing at a bottom or a side of the current conductor exposed to the inside of the vessel;

said current conductor of the composite electrode being formed by a cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space with one end of the composite electrode is exposed to outside of the vessel, said gap being tightly sealed with a metallic layer or a layer made of a mixture of a metal and a material which is same as that forming said vessel.

18. A high pressure discharge lamp according to claim 17, wherein at least one end of the current conductor exposed to inside of the vessel is rounded, the electrode is jointed by metallizing at the rounded end.

19. A high pressure discharge lamp according to claim 17, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

20. A high pressure discharge lamp according to claim 17, at least one end of the current conductor exposed to inside of the vessel is rounded, the electrode is jointed at the rounded by metallizing at the rounded end, a metal or a mixture of a metal and a non-conductive material having at least one of a higher melting point and a higher corrosion resistance than a metal or a mixture of a metal and a non-conductive material jointing the electrode and the current conductor is coated on the joint portion of the electrode and the current conductor and the proximity thereof.

21. A high pressure discharge lamp comprising:

a vessel made of a non-conductive material which forms an inner space filled with an ionizable light-emitting material and a starting gas, and has opening portions at both ends thereof;

a first composite electrode having a substantially cylindrical current conductor with a diameter which is substantially same as a diameter of the opening portion at one end of the vessel and a bottom inclined to an axis thereof exposed to inside of the vessel, and an electrode jointed by welding or metallizing at a bottom or a side of the current conductor exposed to the inside of the vessel; and a second composite electrode having a substantially cylindrical current conductor with a diameter which is smaller than a diameter of the opening portion at the other end of the vessel and a bottom inclined to an axis thereof exposed to inside of the vessel, and an electrode jointed by welding or metallizing at the bottom of the current conductor exposed to the inside of the vessel;

each of said current conductors of the first and second composite electrode being formed by a cylindrical member which is made of a non-conductive material and is coated with a mixture of a metal and a non-conductive material over substantially all of a cylindrical surface thereof;

said metal of the mixture containing not less than 50 vol. % of molybdenum, and said non-conductive material of the first mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the electrode is exposed to the inner space with one end of the first composite electrode is exposed to outside of the vessel; and said current conductor of the second composite electrode and said vessel being so arranged relative to each other as to lease a gap therebetween, with the second composite electrode inserted into the opening portion at the other end of the vessel so that the electrode is exposed to the inner space with one end of the second composite electrode is exposed to outside of the vessel, said gap being tightly sealed with a metallic layer or a layer made of a second mixture of a metal and a material which is the same as that forming said vessel.

22. A high pressure discharge lamp according to claim 21, wherein at least one end of the current conductor exposed to inside of the vessel is rounded, the electrode is jointed by metallizing at the rounded end.

23. A high pressure discharge lamp according to claim 22, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

24. A high pressure discharge lamp according to claim 22, at least one end of the current conductor exposed to inside of the vessel is rounded, the electrode is jointed at the rounded by metallizing at the rounded end, a metal or a mixture of a metal and a non-conductive material having at least one of a higher melting point and a higher corrosion resistance than a metal or a mixture of a metal and a non-conductive material jointing the electrode and the current conductor is coated on the joint portion of the electrode and the current conductor and the proximity thereof.

25. A high pressure discharge lamp comprising:

a vessel made of a non-conductive material which forms an inner space filled with an ionizable light-emitting material and a starting gas, and has opening portions at both ends thereof; and a composite electrode having a cylindrical current conductor with a diameter which is substantially the same as a diameter of the opening portion at one end of the vessel, and a first electrode jointed by welding or metallizing at a bottom or a side of the current conductor exposed to the inside of the vessel;

said current conductor of the composite electrode being formed by a cylindrical member which is made of a non-conductive material and is coated with a mixture of a metal and a non-conductive material over substantially all of a cylindrical surface thereof, and an axis of the first electrode substantially corresponding to that of a second electrode to be opposite to the first electrode;

said metal of the mixture coated on said cylindrical member containing not less than 50 vol. % of molybdenum, and non-conductive material of the mixture containing not less than 50 vol. % of a material which is the same as that forming said vessel;

said vessel and said composite electrode having been subjected to a co-firing into an integrated body, with the composite electrode inserted into the opening portion at one end of the vessel so that the first electrode is exposed to the inner space with one end of the composite electrode is exposed to the outside of the vessel.

26. A high pressure discharge lamp according to claim 25, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

27. A high pressure discharge lamp comprising:

a vessel made of a non-conductive material which forms an inner space filled with an ionizable light-emitting material and a starting gas, and has opening portions at both ends thereof; and a composite electrode having a cylindrical current conductor with a diameter which is smaller than a diameter of the opening portion at one end of the vessel, and a first electrode jointed by welding or metallizing at a bottom or a side of the current conductor exposed to the inside of the vessel;

said current conductor of the composite electrode being formed by a cylindrical member which is made of a non-conductive material and is coated with mixture of a metal and a non-conductive material over substantially all of a cylindrical surface thereof, an axis of the first electrode substantially corresponding to that of a second electrode to be opposite to the first electrode;

said metal of the mixture containing not less than 50 vol. % of molybdenum, and said non-conductive material of the mixture containing not less than 50 vol. % of a material which is the same as that forming said vessel;

said current conductor and said vessel being so arranged relative to each other as to leave a gap therebetween, with the composite electrode inserted into the opening portion at one end of the vessel so that the electrode is exposed to the inner space and one end of the composite electrode is exposed to outside of the vessel, said gap being tightly sealed with a metallic layer or a layer made of a mixture of a metal and a material which is the same as that forming said vessel.

28. A high pressure discharge lamp according to claim 27, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

29. A high pressure discharge lamp according to claim 28, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

30. A high pressure discharge lamp comprising:

a vessel made of a non-conductive material which forms an inner space filled with an ionizable light-emitting material and a starting gas, and has opening portions at both ends thereof;

a first composite electrode having substantially cylindrical current conductor with a diameter which is substantially the same as a diameter of the opening portion at one end of the vessel, and a first electrode jointed by welding or metallizing at a side of the current conductor exposed to the inside of the vessel; and a second composite electrode having a substantially cylindrical current conductor with a diameter which is smaller than a diameter of the opening portion at the other end of the vessel, and a second electrode jointed by welding or metallizing at a bottom or a side of the current conductor exposed to inside of the vessel;

each of said current conductors of the first and second composite electrodes being formed by a substantially cylindrical member which is made of a non-conductive material and is coated with a mixture of a metal and a non-conductive material over substantially all of a cylindrical surface thereof, an axis of the electrode of the first composite electrode substantially corresponding to that of the second composite electrode;

said metal of the mixture containing not less than 50 vol. % of molybdenum, and said non-conductive material of the mixture containing not less than 50 vol. % of a material which is the same as that forming said vessel;

said vessel and said first composite electrode having been subjected to a co-firing into an integrated body, with the first composite electrode inserted into the opening portion at one end of the vessel so that the first electrode is exposed to the inner space with one end of the first composite electrode is exposed to the outside of the vessel; and said current conductor of the second composite electrode and said vessel being so arranged relative to each other as to leave a gap therebetween, with the second composite electrode inserted into the opening portion at the other end of the vessel so that the second electrode is exposed to the inner space and one end of the second composite electrode is exposed to the outside of the vessel, said gap being tightly sealed with a metallic layer or a layer made of a mixture of a metal and a material which is the same as that forming said vessel.

31. A high pressure discharge lamp comprising:

a vessel made of a non-conductive material which forms an inner space filled with an ionizable light-emitting material and a starting gas, and has opening portions at both ends thereof and a metal or a mixture of a metal and a non-conductive material coated at the proximity of at least one opening portion; an electrode jointed by metallizing at the proximity of the opening portion so as to be exposed to the inner space; and a plug made of a non-conductive material with a diameter which is substantially the same as a diameter of at least one opening portion, and having an inner surface coated with the metal or the mixture;

said metal of the mixture containing not less than 50 vol. % of molybdenum, and said non-conductive material of the mixture containing not less than 50 vol. % of a material which is the same as that forming said vessel;

said vessel and said plug having been subjected to a co-firing into an integrated body, with the plug inserted into the at least one opening portion.

32. A high pressure discharge lamp according to claim 31, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

33. A high pressure discharge lamp comprising:

a vessel made of a non-conductive material which forms an inner space filled with an ionizable light-emitting material and a starting gas, and has opening portions at both ends thereof and a metal or a mixture of a metal and a non-conductive material coated at the proximity of at least one opening portion;

an electrode jointed by metallizing at the proximity of the opening portion so as to be exposed to the inner space; and a plug made of a non-conductive material with a diameter which is smaller than a diameter of the at least one opening portion, and having an inner surface coated with the metal or the mixture;

said metal of the mixture containing not less than 50 vol. % of molybdenum, and said non-conductive material of the mixture containing not less than 50 vol. % of a material which is the same as that forming said vessel;

said plug and said vessel being so arranged relative to each other as to leave a gap therebetween, with the plug inserted into the opening portion coated on the mixture, said gap being tightly sealed with metallic layer or a layer made of a mixture of a metal and material which is the same as that forming said vessel.

34. A high pressure discharge lamp according to claim 33, wherein the electrode is jointed by welding or metallizing at a bottom or a side of the current conductor exposed to inside of the vessel, a metal or a mixture of a metal and a non-conductive material having at least one of a higher melting point and a higher corrosion resistance than a metal or mixture of a metal and a non-conductive material jointing the electrode and the current conductor is coated on the joint portion of the electrode and the current conductor and the proximity thereof.

* * * * *